US012161907B2

(12) United States Patent
Jones

(10) Patent No.: US 12,161,907 B2
(45) Date of Patent: Dec. 10, 2024

(54) ELECTROMECHANICAL PHYSICAL RESISTANCE DEVICE

(71) Applicant: CO-JONES INNOVATIONS LLC, Tucson, AZ (US)

(72) Inventor: Lowell Dale Jones, Tucson, AZ (US)

(73) Assignee: CO-JONES INNOVATIONS LLC, Tucson, AZ (US)

( * ) Notice: Subject to any disclaimer, the term of this patent is extended or adjusted under 35 U.S.C. 154(b) by 304 days.

(21) Appl. No.: 17/770,244

(22) PCT Filed: Oct. 20, 2020

(86) PCT No.: PCT/US2020/056402
§ 371 (c)(1),
(2) Date: Apr. 19, 2022

(87) PCT Pub. No.: WO2021/080930
PCT Pub. Date: Apr. 29, 2021

(65) Prior Publication Data

US 2022/0401790 A1 Dec. 22, 2022

Related U.S. Application Data

(60) Provisional application No. 62/925,221, filed on Oct. 23, 2019.

(51) Int. Cl.
*A63B 21/00* (2006.01)
*A63B 21/005* (2006.01)
(Continued)

(52) U.S. Cl.
CPC ..... *A63B 21/154* (2013.01); *A63B 21/0059* (2015.10); *A63B 21/0724* (2013.01);
(Continued)

(58) Field of Classification Search
CPC ..... A63B 21/154; A63B 21/0059; A63B 21/0724; A63B 21/0783; A63B 21/4031;
(Continued)

(56) References Cited

U.S. PATENT DOCUMENTS 3,524,644 A * 8/1970 Kane ..... A63B 21/04 482/145
3,635,472 A * 1/1972 Marcyan ..... A63B 21/06 482/101

(Continued)

FOREIGN PATENT DOCUMENTS

WO 2019100117 A1 5/2019

OTHER PUBLICATIONS

International Search Report for corresponding PCT/US2020/056402, mailed Jan. 21, 2021.

(Continued)

*Primary Examiner* — Andrew S Lo
(74) *Attorney, Agent, or Firm* — Sandberg Phoenix & von Gontard, P.C.

(57) ABSTRACT

The present invention describes an electromechanical exercise machine that simulates the inertia and weight of a mass in Earth's gravity field and allows a user to move said simulated mass in the primary degrees of freedom of a traditional barbell free-weight system, with or without the use of various accessories.

20 Claims, 28 Drawing Sheets

(51) Int. Cl.

| | |
|---|---|
| ***A63B 21/072*** | (2006.01) |
| ***A63B 21/078*** | (2006.01) |
| ***A63B 22/00*** | (2006.01) |
| ***A63B 24/00*** | (2006.01) |
| ***A63B 69/06*** | (2006.01) |
| ***A63B 71/06*** | (2006.01) |

(52) U.S. Cl.
CPC ..... *A63B 21/0783* (2015.10); *A63B 21/4031* (2015.10); *A63B 24/0087* (2013.01); *A63B 2022/0084* (2013.01); *A63B 2024/0093* (2013.01); *A63B 2069/064* (2013.01); *A63B 71/0622* (2013.01); *A63B 2209/02* (2013.01); *A63B 2210/50* (2013.01); *A63B 2220/10* (2013.01); *A63B 2220/30* (2013.01); *A63B 2220/40* (2013.01); *A63B 2220/806* (2013.01); *A63B 2220/833* (2013.01); *A63B 2225/20* (2013.01); *A63B 2225/50* (2013.01); *A63B 2230/06* (2013.01)

(58) Field of Classification Search
CPC ..... A63B 24/0087; A63B 71/0622; A63B 2022/0084; A63B 2024/0093; A63B 2069/064; A63B 2209/02; A63B 2210/50; A63B 2220/10; A63B 2220/30; A63B 2220/40; A63B 2220/806; A63B 2220/833; A63B 2225/20; A63B 2225/50; A63B 2230/06; A63B 2022/0082; A63B 2220/80
See application file for complete search history.

(56) References Cited

U.S. PATENT DOCUMENTS

| | | | | | |
|---|---|---|---|---|---|
| 4,252,314 | A * | 2/1981 | Ceppo | A63B 21/154 | 482/104 |
| 4,527,797 | A * | 7/1985 | Slade, Jr. | A63B 21/0626 | 482/104 |
| 4,934,693 | A * | 6/1990 | Santoro | A63B 21/0626 | 482/104 |
| 5,050,868 | A * | 9/1991 | Pearson | A63B 21/0626 | 482/94 |
| 5,215,510 | A * | 6/1993 | Baran | A63B 21/0626 | 482/45 |
| 5,468,203 | A * | 11/1995 | Okonkwo | A63B 21/078 | 482/4 |
| 5,669,859 | A * | 9/1997 | Liggett | A63B 21/0626 | 482/94 |
| 5,688,216 | A | 11/1997 | Mauriello | | |
| 5,944,633 | A * | 8/1999 | Wittrock | A63B 71/06 | 482/4 |
| 7,374,516 | B2 * | 5/2008 | Lundquist | A63B 21/078 | 482/106 |
| 7,549,950 | B1 * | 6/2009 | Lundquist | A63B 21/0783 | 482/106 |
| 7,666,124 | B2 * | 2/2010 | Vaes | A63B 21/156 | 482/135 |
| 7,815,555 | B2 * | 10/2010 | Webber | A63B 21/0783 | 482/106 |
| 8,047,972 | B1 * | 11/2011 | Dean | A63B 1/005 | 482/104 |
| D650,022 | S * | 12/2011 | Lundquist | D21/673 | |
| 8,328,698 | B1 * | 12/2012 | Webber | A63B 21/4043 | 482/106 |
| 9,067,102 | B2 * | 6/2015 | Poppinga | A63B 21/0783 | |
| 9,381,393 | B1 * | 7/2016 | Gonzalez | A63B 21/0783 | |
| 10,245,461 | B2 * | 4/2019 | Bruni | A63B 21/0783 | |
| 10,864,400 | B2 * | 12/2020 | Schween | A63B 21/0724 | |
| 10,864,401 | B2 * | 12/2020 | Schween | A63B 21/154 | |
| 11,110,313 | B2 * | 9/2021 | Gore | A63B 21/0783 | |
| 11,389,690 | B2 * | 7/2022 | Valdez | A63B 21/0615 | |
| 11,565,144 | B2 * | 1/2023 | Habing | A63B 21/063 | |
| D980,354 | S * | 3/2023 | Gong | D21/673 | |
| 11,712,593 | B2 * | 8/2023 | Kilby | A63B 21/00069 | 482/103 |
| 11,813,493 | B2 * | 11/2023 | Sjöblom | A63B 23/1218 | |
| 11,833,386 | B2 * | 12/2023 | Esco | A63B 21/0783 | |
| 2002/0098953 | A1 * | 7/2002 | Scheewe | A63B 21/0783 | 482/94 |
| 2003/0027695 | A1 * | 2/2003 | Lee | A63B 23/00 | 482/99 |
| 2003/0134722 | A1 * | 7/2003 | Greenland | A63B 21/06 | 482/100 |
| 2012/0190503 | A1 | 7/2012 | Shavit et al. | | |
| 2013/0072353 | A1 | 3/2013 | Alessandri et al. | | |
| 2013/0237374 | A1 * | 9/2013 | Ashby | A63B 71/0054 | 482/4 |
| 2014/0256517 | A1 * | 9/2014 | Poppinga | A63B 21/078 | 482/104 |
| 2014/0315689 | A1 * | 10/2014 | Vauquelin | A63B 22/0235 | 482/8 |
| 2015/0141200 | A1 * | 5/2015 | Murray | A63B 22/0087 | 482/52 |
| 2018/0311524 | A1 | 11/2018 | Butler | | |
| 2020/0188719 | A1 * | 6/2020 | Brand | A63B 21/4029 | |
| 2022/0233908 | A1 * | 7/2022 | Neuhaus | A63B 21/078 | |

OTHER PUBLICATIONS

Written Opinion for corresponding PCT/US2020/056402, mailed Jan. 21, 2021.

* cited by examiner

Fig. 8A

| Traditional Barbell | Simulated Barbell |
|---|---|
| User adjusts manually placed rack hooks to closest approximate (but not higher) shoulder height. Barbell without plates is placed on the rack. | **Mode 1**: Barbell is in "free-floating" mode where it is controlled to be counterweighted and stay in a level orientation. User grips center of bar (engaging center grip sensor) and moves it to exact shoulder height and into the "virtual rack zone" where it holds position until start of exercise.<br>*Benefits*<br>*-More efficient and exact setup* |
| User locates plates (typically in 5 lbs increments) and loads them one at a time on the barbell alternately on each side so as not to cause the barbell to tip and spill the plates. Clamps are then installed on each end to prevent plates from falling off during the lift. | **Mode 2**: User enters weight to lift for overhead press and also chooses an optional higher weight for eccentric lowering motion into HMI.<br>*Benefits*<br>*-No practical option for different eccentric weight on standard barbell*<br>*-More resolution of weight choices*<br>*-No searching the gym for the correct plates*<br>*-Privacy of workout settings*<br>*-Less intimidating for novices since weight setting is private*<br>*-More efficient setup*<br>*-No risk of dropping a plate*<br>*-No clamps needed* |
| User crouches slightly, grips the barbell, lifts the barbell off of the rack and steps backward away from the rack. | **Mode 3**: User grips the barbell (engaging left and right grip sensors) and machine gently applies 25% of weight while user is still in virtual rack zone.<br>**Mode 4**: As user steps backward machine applies remaining full weight linearly as a function of remaining distance in the virtual rack zone.<br>**Mode 5**: Fully loaded and out of the virtual rack zone, the user continues to step back. Inertial simulation is activated and auto-leveling is deactivated to fully simulate the barbell free weight.<br>*Benefits*<br>*-While in virtual rack zone user can determine if weight selected is too heavy*<br>*-No need to lift the weight off of the rack as weight is applied upon gripping the barbell*<br>*-No risk of plates falling off barbell (common practice is to not use clamps)* |
| User commences first rep of overhead press (concentric motion). | **Mode 5**: User commences first rep of overhead press. |
| User lowers barbell back to shoulder position (eccentric motion). | **Mode 6**: Machine detects lowering motion and increases weight to eccentric setting.<br>*Benefits*<br>*-Again, standard barbell cannot provide different eccentric loading*<br>*-Eccentric loading has many strength, flexibility, and fitness benefits* |

Fig. 8B

| Traditional Barbell | Simulated Barbell |
|---|---|
| User completes seven more reps out of a set of ten. Upon the ninth press user feels fatigued and cannot complete the press. The barbell is lowered back to shoulder position. | **Mode 5/6**: User completes seven more reps out of a set of ten. Upon the ninth press user feels fatigued and cannot complete the press.<br>**Mode 5**: Using predetermined user biomechanics data, machine detects user fatigue due to stalling motion prior to full press extension and transitions to Mode 7.<br>**Mode 7**: Before user fails the press, weight is smoothly decreased until press can be completed.<br>*Benefits*<br>*-Increased safety during uncontrolled motion*<br>*-Strength benefit of finishing rep*<br>*-Emotional benefit of finishing rep* |
| Even though fatigued, user attempts one last rep. As the press is attempted the user's muscles fail and the weight is dropped.<br>*Note: An experienced weight lifter at this point will most likely push the barbell forward, roughly guiding it to slam into the floor upon failure, whereas an inexperienced weight lifter might try to (unsuccessfully) control the dropping weight.* | **Mode 5**: Even though fatigued, user attempts one last rep. As the press is attempted the user's muscles fail and the barbell is released (disengaging left and right grip sensors) causing machine to immediately switch to a safer Mode 1. Machine logs failure data to be used in algorithm for future exercise weight setting and reps recommendations.<br>**Mode 1**: Original free-floating mode allows the user to determine next steps.<br>*Benefits*<br>*-Mitigates risk of dropping weight on head or body*<br>*-Mitigates risk of injuring muscle(s) during uncontrolled motion*<br>*-Mitigates risk of dropping weight causing injury to other persons nearby*<br>*-Mitigates risk of dropping weight damaging nearby equipment or flooring structure*<br>*-Negates sound of impact from weights hitting floor*<br>*-Negates need for spotter* |
| If not injured or mortally embarrassed, user must ask for assistance to lift barbell back on rack or remove the plates from the barbell that is now on the floor in order to lift the unweighted barbell back into its rack position.<br>If exercise is completed, gym etiquette dictates the plates be removed from the barbell and placed in their proper racking locations. | **Mode 1**: Because simulated barbell discreetly saved user from injury, no one in the gym is the wiser. User moves the barbell back into the virtual rack zone and completes exercise session.<br>If session is completed, user simply "logs out" on HMI and leaves simulated barbell station.<br>*Benefits*<br>*-No user embarrassment from failure*<br>*-Simplified failure recovery increases workout efficiency and motivation*<br>*-No re-racking of plates required*<br>*-Increased efficiency of allowing next user to access machine* |

ELECTROMECHANICAL PHYSICAL RESISTANCE DEVICE

CROSS REFERENCE TO RELATED APPLICATION

The present application is the US national stage under 35 U.S.C. § 371 of International Application No. PCT/US2020/056402 which was filed on 20 Oct. 2020, and which claims priority to U.S. Provisional Application No. 62/925,221, filed 23 Oct. 2019, the disclosures of which are herein incorporated in their entirety.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

The present disclosure relates generally to the field of exercise equipment devices and, more specifically, to the subfield of weight-training exercise equipment devices that provide simulative kinesthetic feedback to the user.

BACKGROUND OF THE INVENTION

This section provides background information related to the present disclosure, which is not necessarily prior art.

Exercise equipment devices are well established in modern industry and are designed to be used during physical exercise activity to enhance said exercise in various desirable ways, such as enhancing the effectiveness or efficiency of strength, aerobic, anaerobic, or conditioning training. One subset of commonly available exercise equipment devices is those which enhance "strength-training" such that the devices enhance the strength or conditioning of certain muscles or muscle groups of the user's body. Various well-known means exist by which such strength-training exercise enhancements are achieved. For example, certain strength-training exercise equipment devices provide a resistive element to an exercise, such that the movement being made by the user is opposed, thereby making such movement more difficult to accomplish. As another example, certain other exercise equipment devices within the strength-training category are comprised of weight elements, such that the movement being made by the user is opposed against the force of gravity as the weight elements are lifted by the user. Yet other strength-training exercise equipment devices employ a combination of such resistive and weight elements to achieve the desired exercise enhancement.

In order to achieve the desired strength-training results for a given user, it is commonly necessary to make adjustments to the resistive or weight elements of the employed exercise equipment device, such that said exercise equipment device is properly "set up" for that particular user's desired workout routine. The adjustments required for a desired workout routine can be laborious and time-consuming, and may require the addition or removal of weights to or from the exercise equipment device, the tightening or loosening of various mechanisms within the exercise equipment device, or even the rearrangement of certain sub-mechanisms of the exercise equipment device, such as pins, keys, or latches. Furthermore, the user must have a means of remembering the desired set of adjustments to make for a given workout routine. Depending on the user's desired routine, many such adjustments may need to be made during a given workout session, such that the exercise equipment device is properly set up for each individual unique exercise movement, or "exercise set", within the user's complete workout session. Additionally, a typical workout session requires performing a variety of exercises, each of which being carried out on a different piece of strength-training equipment, often with multiple exercise sets carried out per exercise. This reality not only requires the user to remember or record the equipment setting for each exercise, but often leads to time delays and frustration on the part of the user as equipment is often taken by a different user between exercise sets forcing the user to "wait their turn".

In the specific case of weight lifting, one category of commonly utilized exercise equipment devices is known as "free weights" or "free weight systems" or "functional strength training systems". Free weights can, in certain embodiments take the form of a simple barbell, which is typically a long metal bar to which disks or "plates" of varying weights can be attached at both ends. The barbell is designed, typically, to be grasped by a user with both hands, and then lifted from a lower position to a higher position, thereby employing the downward force of gravity to oppose the upward force being applied by the user.

Free weight systems are a preferred type of exercise equipment devices among many users, because they, unlike many other types of strength-training exercise equipment devices which constrain the user's motion along a certain path of motion, provide minimal constraint against any possible direction of motion made by the user. This lack of constraint requires the user to stabilize the weight by employing proper flexibility and form and by activating additional muscles and muscle groups not required from the resistance of a typical path-constrained machine. Also because of this lack of constraint, however, free-weight systems have a comparably higher degree of danger in their use because their movement, if not correctly controlled by the user, can be erratic and unpredictable. This erratic and unpredictable movement, such as undesired dropping or undesired directional movement, can easily cause injury to the user, injury to others located nearby, or physical damage to items or structures in the surrounding physical space. To alleviate some of this additional danger inherent in the use of free-weight systems, users often elect to utilize a helper, or "spotter", to help facilitate their exercise routine and be on-the-ready to aid in taking control of the movement of the free-weight system if its movement does become uncontrolled.

Because free-weight systems are, by their nature, comprised of various weights, certain heavy free-weight systems require specialized surroundings, such as lifting rack frame structures or "power racks", a large open surround area and a reinforced floor structure, to support the weight of the systems, as well as to endure impacts from uncontrolled or unintentional motion of the free-weights. Additionally, space and racking is needed for the multiple sets of plates required for each free-weight station.

One example of a barbell-style weightlifting apparatus that does not require a conventional spotter is disclosed in PCT application WO2005030341A1 (Blackwell). As disclosed, the apparatus is a conventional free weight rack system, with physical weights, but with servo-controlled spotting arms.

Another example of an exercise apparatus providing simulated free weight exercises is disclosed in U.S. Pat. No. 5,725,459 (Rexach). This reference discloses a stacked weight-based barbell device using real weight plates and a mechanically-adjustable cable system.

Since the advent of electricity, and later, computerized control mechanisms, various motorized and computerized exercise devices also became known in the art. For example, U.S. Pat. No. 4,934,694 (McIntosh) discloses a computer-controlled exercise system which applies constant torque to motors to provide resistance against the user's motion. Another example, U.S. Pat. No. 4,235,437 (Ruis, et al.) teaches a robotic exercise machine with motorized linkage systems. A third example, U.S. Pat. No. 5,577,981 (Jarvik) teaches a virtual reality exercise system integrated to the orientation of a user's head. Finally, a fourth example, U.S. Pat. No. 6,280,361 (Harvey, et al.) discloses a cable-based computerized system that provides resistive force against the user's path of motion.

More recent exercise device inventions teach mechanisms or methods for providing varying resistance against a user's motion using computer-controlled means. For example, U.S. Pat. No. 8,968,155 (Bird) teaches a DC motor system with variable input resistance to the motor in order to vary the motor's torque force and thereby resist a user's movement in a pre-programmed mode. Another example, U.S. Pat. No. 10,661,112 (Orady et al.) teaches a pancake style motor and cable-based design to implement a counterforce using a frequency-controlled AC motor. Finally, a third example, U.S. Pat. Application No. 2014/0315689 (Vauquelin, et al.) discloses an approach to simulating the interaction with a mass allowing the user to set load and artificial inertia parameters independently of one another.

There is thus a need in the art for an exercise system and method that simulates free weight exercise movements such that the primary degrees of freedom of a traditional free weight barbell are present; eliminates the requirement of lifting actual physical barbell weights against the force of gravity; eliminates the need for a spotter or elaborate impact-resistant structures; reduces or eliminates the need for a time-consuming mechanical setup procedure for individual users; and accommodates pre-programmed exercise modes, including but not limited to the simulation of a free-weight exercise system in Earth's gravity environment, based on any combination of preprogrammed or user-selectable variables.

SUMMARY OF THE INVENTION

This section provides a general summary of the disclosure and is not a comprehensive disclosure of its full scope or all of its features.

The invention herein describes an electromechanical exercise machine that, in its basic form, imparts a force or forces to one or both ends of a lifting bar in order to simulate various resistances including, but not limited to, simulating the inertia and weight of a loaded traditional barbell in the Earth's gravity field. The invention also allows a user to move said lifting bar in the primary degrees of freedom of a traditional barbell free-weight system, and wherein such degrees of freedom are further described herein.

The invention alleviates typical safety issues caused by the possibility of uncontrolled user motion that is present in traditional barbell free-weight systems by: 1) using a stage system hereinafter further defined to control the force and position of the barbell, 2) utilizing sensors to measure the user's interaction with the barbell, and 3) applying algorithms to enact safety measures. For example, algorithms in certain exemplary embodiments of the invention provide a grip-sensing control mechanism, herein referred to as a "grip sensor", such that if the user of the invention releases the barbell, the simulated gravitational field weight of the simulated mass can be reduced such that no harm comes to the user, hardware or surrounding environment including other people nearby.

Because of the fact that the mass of a traditional weighted barbell is simulated in the invention, rather than being an actual mass, a reinforced flooring structure to support the invention's weight, which is commonly needed in traditional weighted barbell systems, is not necessary. Even the barbell itself can be any desired simulated weight and not constrained to, for example, the standard 45-pound base weight found in most traditional commercially-available weighted barbells. In certain embodiments, the weight of the barbell accessory itself can be mitigated via "counterweighting" it using the stage actuation, effectively making the barbell weightless if such weightlessness is deemed desirable by the user. This benefit of certain embodiments can be useful for users incapable of lifting a standard 45-pound barbell. Additionally, as compared to traditional weighted barbell systems, the invention eliminates the noise and floor damage from weights being dropped that is generally present in traditional weighted barbell systems; and the invention further removes the need for weight storage space.

In exemplary embodiments of the invention, the invention comprises one or more commercially-available processors and controllers, which together enable the invention to provide a desired physical behavior based on a programmed input algorithm. As used herein, a processor is a commercially-available device that is capable of accepting data from a broad range of sensors and similar input devices, and then performs calculations based on a desired algorithm. Based on the results of said calculations, said processor then outputs instructions to one or more controllers. A controller, as used herein, is a lower-level, commercially-available dedicated device, that has a purpose to do one or more physical tasks, such as a task to move a motor. Controllers often also comprise a small built-in processor to enable it to do a task with closed-loop feedback to ensure the task is completed. As should be evident to those skilled in the art, processors and controllers can be separate entities or the controller functionality can be a capability within a commercially available processor or the controller can be a distributed system integrated between the processor and various motor or driver mechanisms.

In certain exemplary embodiments, the invention further comprises a human-machine interface, or "HMI", such as a commercially-available touchscreen, and wherein said HMI allows a user to interact with the invention and adjust certain parameters to achieve desired behaviors of the simulated mass. In certain exemplary embodiments of the HMI, remote interaction with the machine is enabled through an online access account using a software application, or "app", via a computer, smart phone, computerized pad, or other similar device. In certain exemplary embodiments, a display may be utilized for communicating video, images, or software information to the user. In certain exemplary embodiments, the HMI may also act as said display.

In certain exemplary embodiments of the invention, individual user data is electronically stored within the invention such that it can be recalled by a user as desired. Such stored data comprises, but is not limited to, biomechanics information, exercise routines, weight levels achieved, and schedule of exercise.

The structural design of certain preferred embodiments of the invention is based on a lifting bar (hereinafter "simulated barbell" or "barbell accessory") removably connected on each end to a "stage", and wherein said stage is a physical way or rail mechanism to constrain motion, along with a driver mechanism to enable, as desired, any one or more of the controlled motion, controlled positioning, and controlled force of a payload carriage within the constrained region of motion. In the specific embodiment case of a planar stage, the motion of the payload carriage is constrained to a planar surface.

In certain exemplary embodiments, only one stage is present. In certain exemplary embodiments, the one or more stages are hingedly affixed to a wall or other structure to allow for the one or more stages to be collapsed into a compact configuration for storage when the invention is not in use.

The motion of a payload carriage within the constrained region of motion of such a stage can be enabled via many well-known mechanical mechanisms, including but not limited to standard ballscrew/leadscrew mechanisms, rack-and-pinion systems, pneumatic devices, hydraulic devices, cable-driven mechanisms, belt-driven technologies, electromagnetic linear motors, or other commercially available solutions for such applications which should be evident to those skilled in the art.

For purposes of clarity of explanation of certain preferred embodiments of the invention comprising a planar stage, the constrained region of motion of a such a planar stage within the invention can be described as an X-Y plane, wherein the X-direction is defined as being parallel to the floor upon which the invention is located and thereby generally perpendicular to the Earth's gravity vector, and the Y-direction is defined as being generally parallel to the Earth's gravity vector. In certain preferred embodiments, the invention comprises two such X-Y planar stages, with the X-Y plane of each of the two stages being located parallel to the other, and an aforementioned simulated barbell being securably affixed at each end to one of the X-Y planar stages via a flexure, ball/socket, linkage mechanism or similar attachment apparatus, hereinafter referred to as the "accessory union".

In exemplary embodiments, said accessory unions allow for up to five degrees of freedom of motion of the simulated barbell, taken from the perspective of the user. Specifically, four of the degrees of freedom can be defined as vertical (along the aforedefined Y-direction), horizontal (along the aforedefined X-direction), yaw (rotation about the axis of the aforedefined Y-direction) and roll (rotation about the axis of the aforedefined X-direction). The simulated barbell may also be allowed to freely rotate about its own axis, providing for a $5^{th}$ degree of freedom. Passive or actuated motion and force along the simulated barbell's axis (hereinafter termed the Z-direction or pitch axis) may also be incorporated in exemplary embodiments, and in certain embodiments can be enabled via a passive spring-loaded, self-centering mechanism, providing the potential for a $6^{th}$ degree of freedom.

In certain embodiments incorporating a simulated barbell and two parallel planar stages, the two accessory unions of the invention are enabled to each accept one end of the simulated barbell, and wherein the simulated barbell is broadly designed to emulate the physical structure of any one or more various traditional barbells, such as those presently well-known and commercially-available in the exercise industry as a standard barbell, an Olympic barbell, a trap/hex barbell, a safety squat bar, a Swiss bar, an EZ curl bar, a super curl bar, an axle bar, or a 360 grip curl bar.

In certain exemplary embodiments, the invention provides flexibility of incorporating additional specialized accessories in place of the simulated barbell, in order to simulate other standard gym exercises such as cable pulls, dumbbells, rowing machine, kettle bell, and battle ropes. In additional exemplary embodiments for certain specialized accessories, the invention may be embodied with only one planar stage and one accessory union.

In certain exemplary embodiments, each simulated barbell or other specialized accessory may incorporate its own sensor and/or actuation elements to further enhance the invention's simulation and safety mechanism capabilities. For example, the simulated barbell may itself comprise grip sensors as a means to determine whether the user has released the simulated barbell during an exercise, so that controlled safety measures can be applied such as reducing or eliminating the applied exercise load to prevent user injury.

Those skilled in the art will recognize that the invention as described herein provides wide flexibility in operation and an ability to enact generalized stand-alone control schemes or fully generalized multi-input, multi-output (MIMO) "finite state machines" composed of several control schemes or modes, including transition programming as the machine switches between modes. As an example of a stand-alone control scheme, the invention may be programmed to simply simulate a mass in a gravity field by applying a constant force in the downward (Y) direction. As an example of a finite state machine, the invention in certain embodiments may again be programmed to simulate a mass in a gravity field, however when the user releases the simulated barbell, instead of allowing the motor to drive the simulated barbell rapidly to the floor, the algorithm of the invention can utilize input data from a velocity sensor to switch to a "safe mode" once the velocity reaches a predetermined critical speed, subsequently stopping or slowing the simulated barbell before it hits the floor or causes injury to the user.

As a specific embodiment example, the invention can be viewed as a finite state machine when embodied for purposes of illustration as physically comprising two planar stages positioned parallel to each other, with each of the two planar stages with coordinate systems defined as $(x_1, y_1)$ and $(x_2, y_2)$ respectively. Then, the force output of any direction of the machine $(x_1, y_1, x_2, y_2)$ can be stated as: $\vec{F}_{out}=f_n(\vec{P}, \vec{V}, \vec{A}, \vec{F}, \vec{S})$, where:

$f_n$=generalized function for $n^{th}$ mode;

$\vec{P}$=array of all measured positions $(x_1, y_1, x_2, y_2)$;

$\vec{V}$=array of all measured velocities $(\dot{x}_1, \dot{y}_1, \dot{x}_2, \dot{y}_2)$;

$\vec{A}$=array of all measured accelerations $(\ddot{x}_1, \ddot{y}_1, \ddot{x}_2, \ddot{y}_2)$;

$\vec{F}$=array of all measured forces $(F_{x1}, F_{x2}, F_{y1}, F_{y2})$;

and $\vec{S}$=array of all remaining sensor measurements, e.g. gripping sensors for the simulated barbell.

Similar generalized relations can also be written for the finite state machine's output positions and output velocities.

A schematic of one embodiment of a generalized control layout is shown in FIG. 1. It should be noted that, as clarified previously herein, while the controller/processor is shown as a single block, in practice it is often realized as separate subsystems such that a processor might be used as the mode controller for the finite state machine while lower level controllers located at the motors might perform the commanded control protocol.

Furthermore, while two types of interface to the controller/processor are shown for software updates and/or general programming, only one may be employed; while two types of interface to the controller/processor are shown, the interface may rather connect via the HMI; while encoders are shown located on the motors, they may be rather located on the linear rails; while no velocity sensor is shown, those skilled in the art will recognize that the position encoder signal can simply be differentiated to estimate velocity; while no velocity sensor is shown, this omission doesn't preclude the use of a separate velocity sensor; while the accelerometer sensors are shown in proximity to the simulated barbell, this doesn't preclude acceleration being measured or inferred non-locally by other means, e.g. differentiation of the velocity signals to estimate accelerations; while the force sensors are shown in proximity to the simulated barbell, this doesn't preclude force being measured or inferred non-locally by other means. For example, the motor torques can be utilized to infer the linear output forces, or a pressure sensing pad can be employed for the user to stand on; while the user data is shown as a data storage block as either fixed or removable media, it could also be stored in the memory of the controller/processor or accessed via the cloud interface or transmitted via a wireless device such as a smart phone, smart watch, or similar; and while the brakes/clutches are shown as attached to or in proximity to the motors, they could also be located directly on the linear rails.

Below, several embodiments of the control schemes are discussed. These example embodiments can be viewed as simplified embodiments of the generalized control layout shown in FIG. 1.

To enable an embodiment of the invention wherein the embodiment simulates a standard free-weight in gravity and inertial system, FIG. 2 shows the classic free-body diagram representation of a mass, m, in a gravity field, g, with the resulting force exerted on it, mg. Additionally, a user-applied force $F_u$ is shown imparting an upward acceleration on the mass, $\ddot{y}$. The reaction force against this acceleration is $m\ddot{y}$ according to Newton's second law.

When all of the forces are summed, the following equation of motion results:

$$F_u = mg + m\ddot{y}.$$

Hence, the user experiences a force that is a combination of a constant force (weight) due to gravity and a dynamic force proportional to how quickly the user can accelerate the mass. Note that while the constant force is always in the negative (downward) direction, the acceleration can be either positive or negative. A typical Olympic weight lifter will use this dynamic to their advantage by maximizing the acceleration of the mass during the upward lift of the barbell, and because the barbell will have to decelerate before it can begin its descent, the weight lifter has time to re-position their body beneath the barbell as in the case of an Olympic "snatch" or their upper body beneath the barbell as in the case of an Olympic "clean".

Implementing this physical system as a simulated weight using a motor (or actuator), accelerometer, and control system is straightforward for one skilled in the art, as per an embodiment shown in FIG. 3.

The control system shows a signal representing the fixed weight, mg, summed with a feedback signal from the accelerometer multiplied by a gain representing the mass, m. The summed signal is fed through a transfer function which is derived to command the motor to produce the required simulated force to the user, $F_u$. For example, this transfer function might simply consist of a scaling gain or might consist of a voltage-to-current transformation to control the motor's torque. When considered in relation to the general control layout of FIG. 1, this embodiment could clearly include an HMI such that the user could set the desired mass to simulate.

For simulating a resistive force that is linearly proportional to displacement of the barbell or accessory, a classic linear spring model can be employed. The model of this type of system embodiment is shown in FIG. 4, where k is the linear spring constant and, again, $F_u$ is the force exerted by the user.

The equation governing the reactive force is simply, $F_u = kx$, and the control system implementation of that equation is shown in FIG. 5.

Unlike FIG. 3, the control system represented in FIG. 5 extracts an encoder (position) signal from the motor and applies a gain of k to produce the resistive force. Note, the null or zero input is shown to represent the simulated spring starting at the x origin or starting position. However, a constant offset could be inserted which would simply start the simulated spring at a different origin position.

The simulation of a linear spring can be used to mimic elastic band types of exercises where the user experiences more resistance the further the barbell or accessory deviates from an origin position. Note that while this example embodiment describes the simulation of a linear spring, there is no limitation of such linearity. Specifically, the spring value, k, can be non-linear, or it can be embodied as a function of other finite state machine variables.

For simulating a resistive force that is linearly proportional to velocity of the barbell or accessory, a classic linear damper model can be employed. An exemplary model of this system is shown in FIG. 6, where c is the linear damper constant and, again, $F_u$ is the force exerted by the user.

The equation governing the reactive force is simply, $F_u = c\dot{x}$.

The control system implementation for this equation is shown in FIG. 7. This FIG. 7 embodiment implementation is very similar to that shown in FIG. 5, however this simulation performs an additional mathematical differentiation operation, $$\frac{d}{dt},$$

on the encoder (position) signal from the motor to calculate a velocity and then applies a gain of c to produce the desired resistive force.

The simulation of a linear damper can be used to mimic types of exercises where the user experiences more resistance proportional to the speed of device motion. Examples include activities involving motion through a viscous medium such as rowing or equipment that acts as an energy drain due to rubbing or internal friction such as battle ropes.

To provide more clarity of a preferred embodiment of the invention's control system and the transitioning between multiple finite state machine "modes", FIG. 8 shows a side-by-side comparison of the processes involved in performing an overhead barbell press with a traditional barbell and a simulated barbell within the invention described herein.

The comparison is made using a standard overhead barbell press (otherwise known in the exercise industry as a military press) where the standard barbell is lifted at shoulder height from a rack and then lifted or "pressed" to full extension of the arms above the head and then lowered back to the shoulder position thereby completing a full repetition or "rep" as shown in FIG. 9.

It should now be evident that removing the detachable simulated barbell accessory of the invention when it is embodied in a two parallel planar stage form will provide a user with two planar stages capable of accepting various accessory attachments that can simulate a variety of industry-standard exercise or therapy equipment devices. Three such accessories are described herein—a cable pull accessory, an abs/back accessory, and a rowing machine accessory.

An embodiment configuration of the invention to simulate cable pulls is easily enabled. After the simulated barbell accessory is removed, a cable-pulley system is attached to each side of the invention with the stages being used as the load producing elements. In embodiments with two parallel planar stages, both stages of the embodiment can be fitted with this accessory. Alternatively, only one stage can be utilized with a single-sided cable pull accessory.

An embodiment configuration of the invention to simulate a combination abdominal and back, herein referred to as "abs/back", exercise device is easily enabled. The simulated barbell accessory is fitted with a pad mounted concentric to the bar or alternatively, the barbell accessory is removed and replaced with the abs/back accessory bar. Additionally, a standard, commercially available exercise bench is employed on which the user sits. The generalized programmable functionality of the invention can then be employed to restrict the motion of the accessory to a specific arc-shaped path similar to that experienced in a standard abs/back exercise machine. Finally, the invention imparts a force to the user's motion along said arc-shaped path to provide the simulated resistance necessary for either the abs or back exercise.

An embodiment for a rowing machine mimics the structure of a typical commercially available rowing machine, wherein this accessory embodiment consists of a sitting platform capable of sliding forward and backward on a passive rail system. However, unlike typical rowing machines each simulated "oar" would be affixed to its respective planar stage through a pivot mechanism similar to that used on a rowing boat. Each stage can impart a generalized force to the end of the simulated oar (the end of the oar in the water) and can also sense the simulated oars' positions. These capabilities allow for simulating a viscous resisting force proportional to velocity when the oar is in the downward (in the water) position and a less resistive force when the oar is in the upward (in the air) position. Additionally, the oars of the rowing accessory could incorporate a rotational sensor to determine if the orientation of the oars are "square" or "feathered" and thereby simulate the proper amount of water/air resistance and forward propulsion. Finally, although the embodiments shown simulates "sculling" (a rower having two oars), it could just as easily be designed to simulate "sweep-oar rowing" (a rower engaging only one oar as part of a rowing team). Further embodiment accessories should be evident to a person skilled in the exercise industry.

Because the invention provides for fully programmable generalized force and position profiles, applicability beyond a piece of gym equipment should be obvious to those versed in the art. Relevant applications of the invention further comprise physical therapy, occupational therapy, sports science, and physiology research. As such, exemplary embodiments of the invention described herein are a generalized exercise, rehabilitation and research platform for which third-party developers can develop both software "apps" and hardware accessories to provide further functionality and benefits to the user. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations and are not intended to limit the scope of the present disclosure.

In the drawings:

FIG. 8 represents an overhead press exercise scenario comparison between a traditional barbell and the invention's simulated barbell, transitioning between multiple finite state machine "modes".

DETAILED DESCRIPTION

Example embodiments will be described more fully with reference to the accompanying drawings.

The accompanying drawings are provided to show illustrative examples of certain preferred embodiments of the invention.

Figure 1:
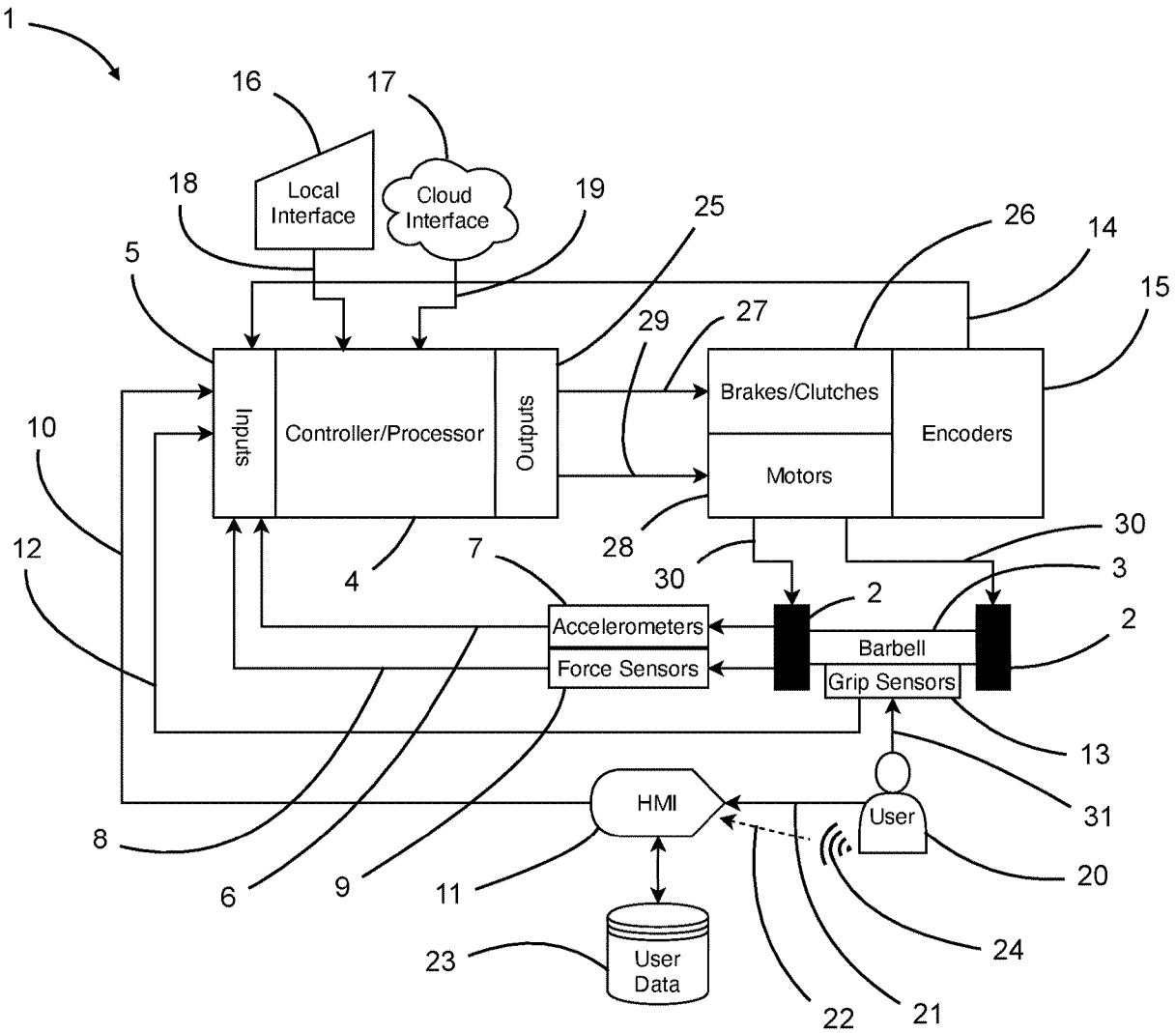
FIG. 1 represents a schematic of a generalized control layout for certain embodiments.

Referring now to FIG. 1, a block diagram layout of a generalized finite state machine, or "FSM", 1 is depicted. In this embodiment it is shown controlling a dual planar stage 2 with a barbell accessory 3. A controller/processor 4 receives multiple inputs 5 including, but not limited to, acceleration signals 6 from the accelerometers 7, force signals 8 from the force sensors 9, user input signal 10 from the human machine interface, or HMI, 11, grip sensing signals 12 from the grip sensors 13, and position/velocity signals 14 from the encoders 15. Additionally, the controller/processor 4 can be programmed using a local interface 16 and a nonlocal interface such as herein depicted as cloud interface 17. The local interface signal 18 and cloud interface signal 19 can be by any combination of direct/wired connection and wireless connection. The user input signal 10 generated from the HMI 11 is determined by the user 20 by any combination of input through direct user interaction 21, wireless signal 22, and stored user data 23. Wireless interaction via wireless signal 22 is accomplished using a wireless device 24 such as a smart phone. Direct user interaction 21 with HMI 11 is accomplished using any commercially-available HMI device, such as a touchscreen. The controller/processor 4 is algorithmically programmed to generate output controls 25 to the brakes/clutches 26 via the brake/clutch control signal 27, the motors 28 via the motor control signal 29 and any other necessary actuation (not shown) to present the desired force and position profile of the barbell accessory 3 to the user 20. The motors 28 and brakes/clutches 26 interface to the dual planar stages 2 through mechanical transmissions 30 such as, but not limited to, belts drives, ballscrews, or cable drives. The user interaction with the barbell accessory 31 produces changes in some or all of the inputs 5 thereby closing the loop of the overall generalized FSM 1.

Figure 2:
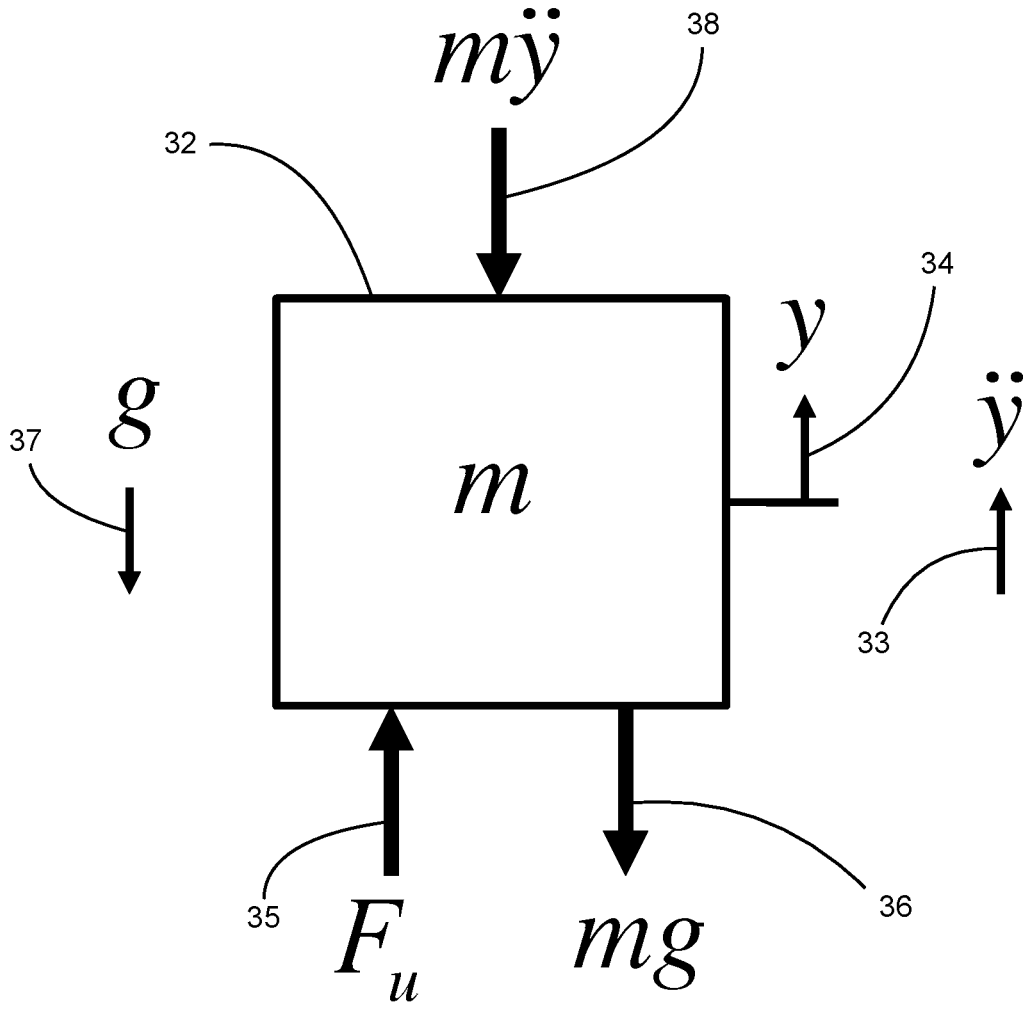
Fig. 2 Prior Art
FIG. 2 represents a free-body diagram of mass being accelerated upward in a gravity field due to the force of a user.

Referring now to prior art as depicted in FIG. 2, a "free body diagram" of the forces acting on a mass in a gravity field is shown. The mass 32 is shown with a direction of acceleration 33 in the positive vertical direction of motion 34 due to the input force of the user 35. A constant force/weight due to gravity 36 is shown caused by the gravity vector 37. Finally, a reaction force due to acceleration 38 of the mass is shown obeying Newton's Second Law of Motion.

Figure 3:
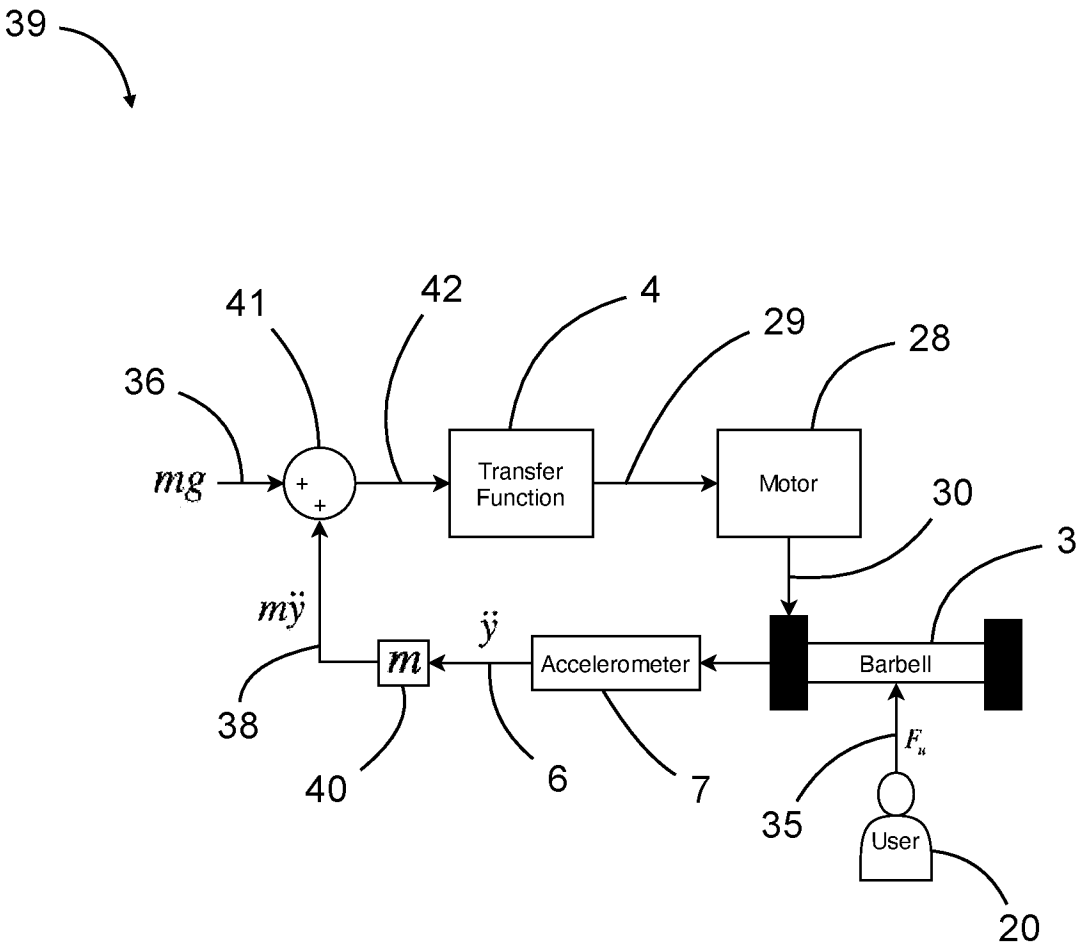
FIG. 3 represents an embodiment of a control system implementation of inertia and weight of a mass in a gravity field.

Referring now to FIG. 3, an FSM simulating the mass in a gravity field 39 from FIG. 2 is shown. A user 20 is shown interacting with a barbell accessory 3 by imparting the force from the user 35. The accelerometer 7 sends an acceleration signal 6 to a gain operator 40, which in turn gains the signal to produce a signal representing the mass's reaction force due to acceleration 38. This signal is added to the constant signal representing the force/weight due to gravity 36 using a signal summation operator 41. The resulting command signal 42 is sent to the controller/processor 4, here represented as a transfer function operator. The transfer function calculates and sends the proper motor control signal 29 to the motor 28. Finally, the motor 28 imparts the reaction force to the barbell accessory 3 via a mechanical transmission 30.

Figure 4:
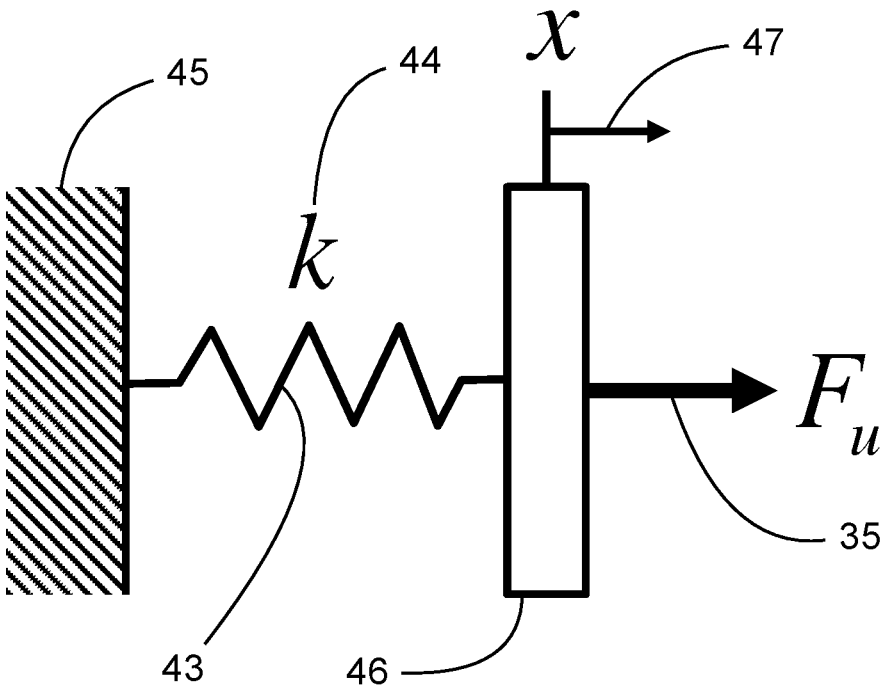
Fig. 4 Prior Art
FIG. 4 represents a classic linear spring system.

Referring now to prior art as depicted in FIG. 4, a classical linear spring system is shown. A linear spring 43 with spring constant 44 is connected to a fixed reference frame 45 on one of its ends and a massless moving reference frame 46 on its other end. The positive horizontal direction of motion 47 is defined. When the positive force of a user 35 is applied, the linear spring 43 will stretch linearly proportional to the spring constant 44. Note that although this representation follows classic linear spring theory, there is no limitation to the spring being linear.

Figure 5:
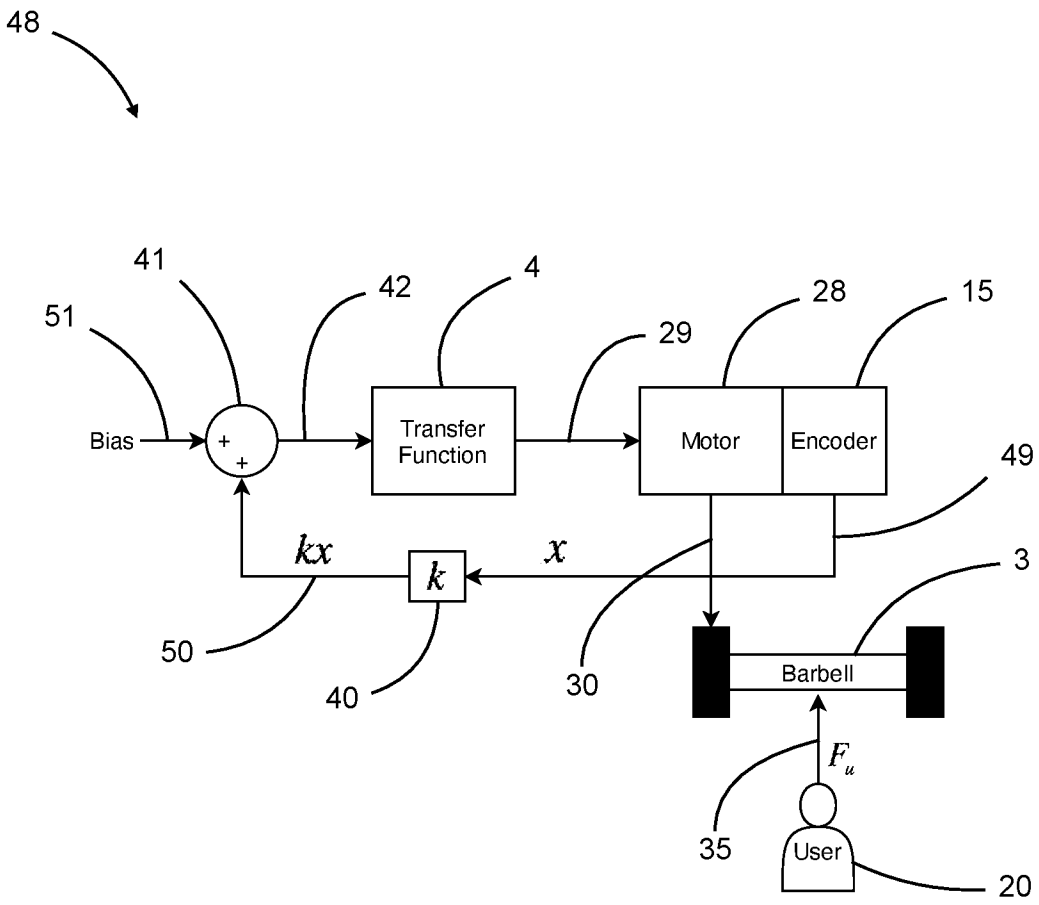
FIG. 5 represents an embodiment of a control system implementation of a linear spring system.

Referring now to FIG. 5, an FSM simulating the classical linear spring 48 from FIG. 4 is shown. A user 20 is shown interacting with the barbell accessory 3 by imparting the force from the user 35. The encoder 15 sends a position signal 49 to a gain operator 40, which in turn gains the signal to produce a spring force signal 50 representing the reaction force due to stretching/compressing the spring. This signal is added to an optional bias input signal 51 (typically null) representing any constant offset/bias force that is desired for inclusion using a signal summation operator 41. The resulting command signal 42 is sent to the controller/processor 4 here represented as a transfer function operator. The transfer function calculates and sends the proper motor control signal 29 to the motor 28. Finally, the motor 28 imparts the reaction force to the barbell accessory 3 via a mechanical transmission 30.

Figure 6:
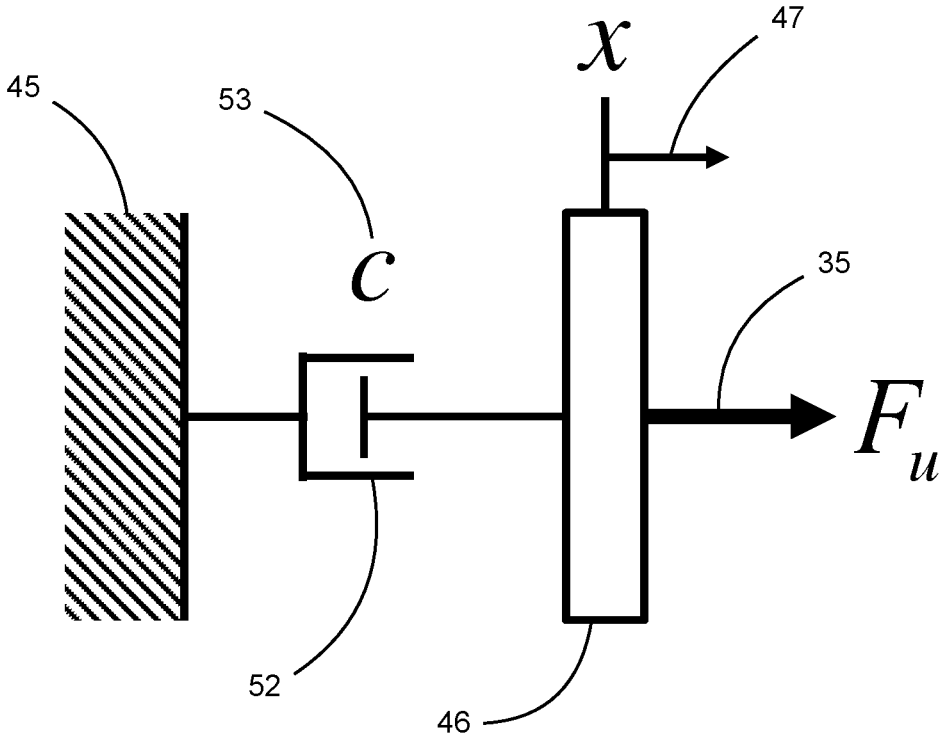
Fig. 6 Prior Art
FIG. 6 represents a classic linear damper system.

Referring now to prior art as depicted in FIG. 6, a classical linear damper system is shown. A linear damper 52 with damping constant 53 is connected to a fixed reference frame 45 on one of its ends and a massless moving reference frame 46 on its other end. The positive horizontal direction of motion 47 is defined. When the positive force of a user 35 is applied, the linear damper 52 will react to the velocity of motion with a force proportional to the damping constant 53. Note that although this representation follows classic linear damper theory, there is no limitation to the damper being linear.

Figure 7:
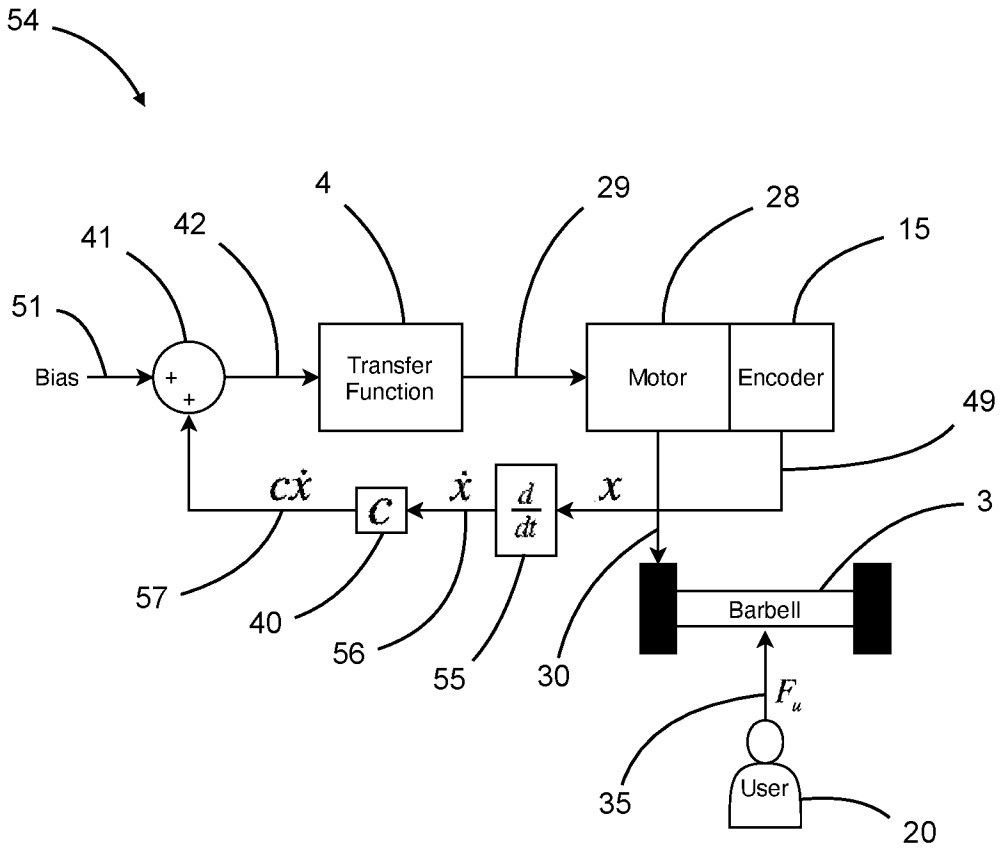
FIG. 7 represents an embodiment of a control system implementation of a linear damper system.

Referring now to FIG. 7, an FSM simulating the classical linear damper 54 from FIG. 6 is shown. A user 20 is shown interacting with the barbell accessory 3 by imparting the force from the user 35. The encoder 15 sends a position signal 49 to a differentiation operator 55 which outputs a velocity signal 56 sent to a gain operator 40 which in turn gains the signal to produce a damper force signal 57 representing the reaction force due velocity of the barbell accessory 3. This signal is added to an optional bias input signal 51 (typically null) representing any constant offset/bias force that is desired for inclusion using a signal summation operator 41. The resulting command signal 42 is sent to the controller/processor 4 here represented as a transfer function operator. The transfer function calculates and sends the proper motor control signal 29 to the motor 28. Finally, the motor 28 imparts the reaction force to the barbell accessory 3 via a mechanical transmission 30.

Figure 9:
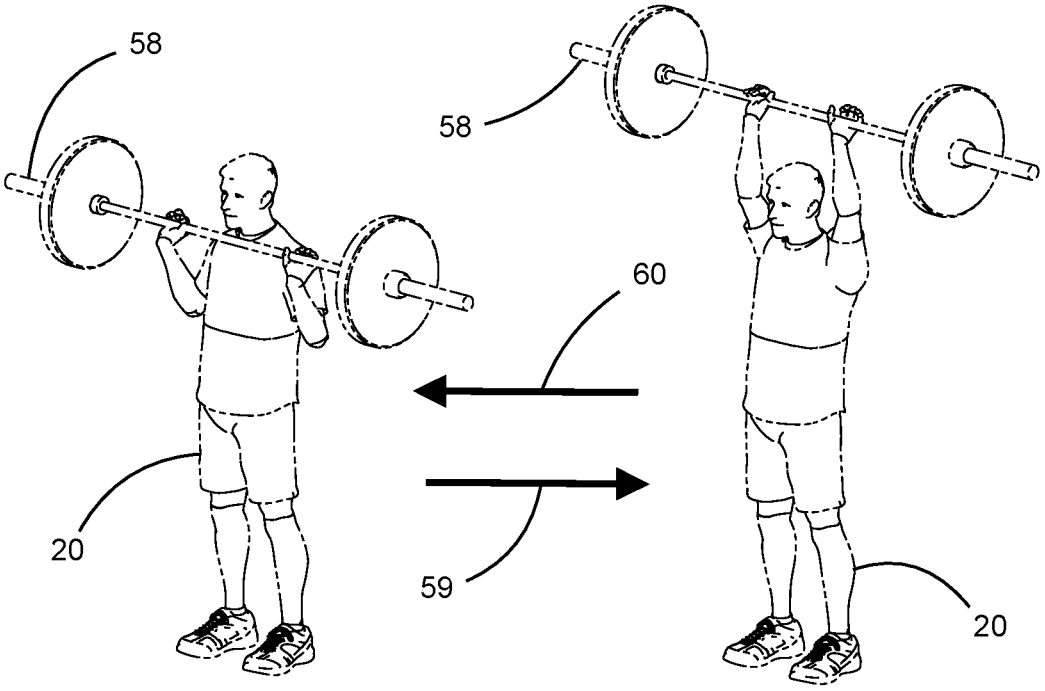
Fig. 9 Prior Art
FIG. 9 represents a user performing an overhead military press exercise using a loaded traditional barbell.

Referring now to FIG. 8, a chart is shown to provide more clarity of a preferred embodiment of the invention's control system and the transitioning between multiple FSM "modes", FIG. 8 shows a side-by-side comparison of the processes involved in performing the overhead/military barbell press detailed in FIG. 9 with a traditional barbell and a simulated barbell within the invention described herein.

Referring now to FIG. 9, an example of a typical barbell overhead/military press exercise is depicted. The left side of the figure depicts a user 20 holding a loaded traditional barbell 58 on his shoulders. The right side of the figure depicts the same user 20 with the loaded traditional barbell 58 extended fully above his head. The pressing motion of the barbell from shoulders to overhead is termed a concentric motion 59 causing a constriction of the muscles being exercised. The lowering motion of the barbell from overhead to shoulders is termed an eccentric motion 60 causing a relaxation or lengthening of the muscles being exercised.

Figure 10:
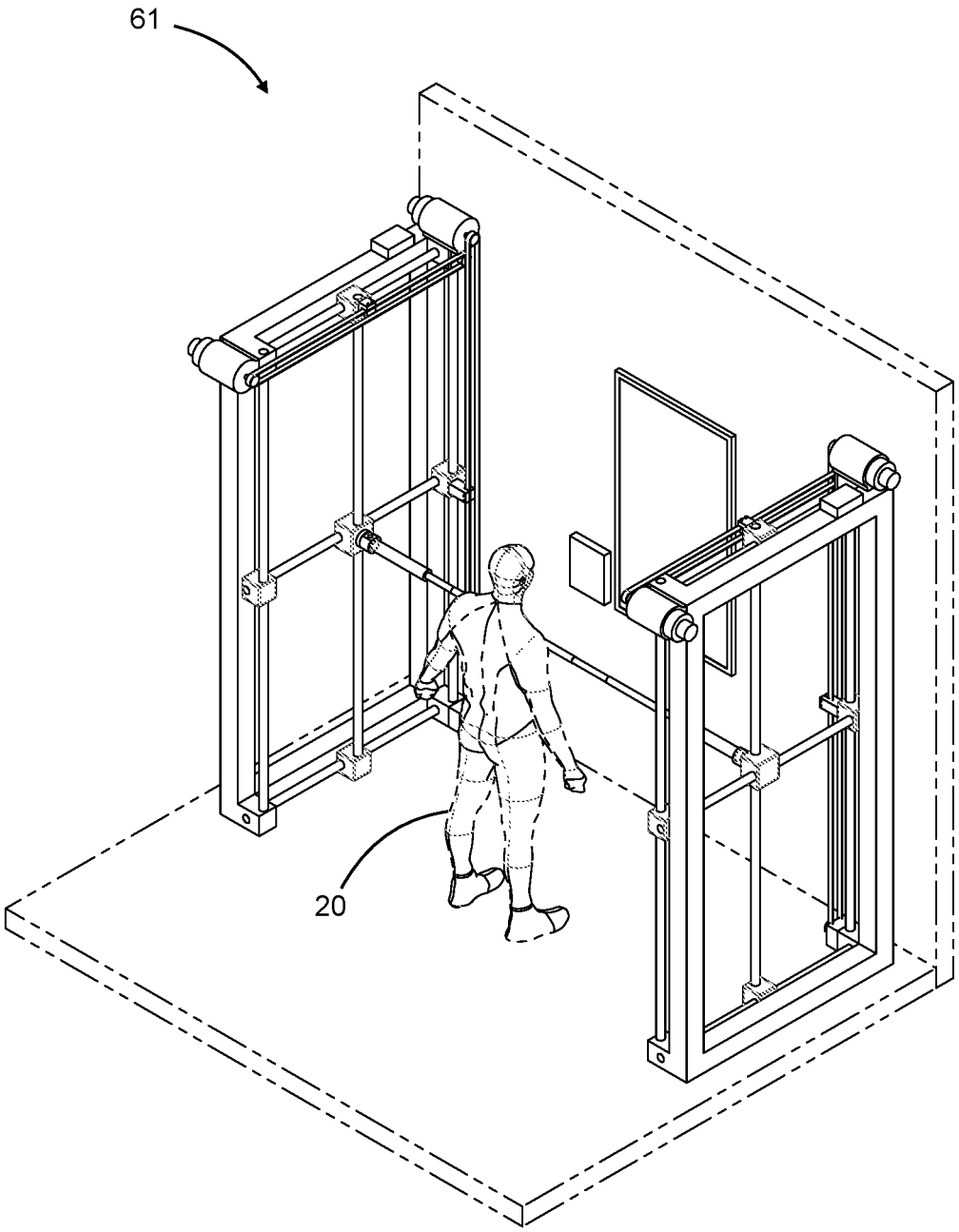
FIG. 10 illustrates a concept overview of a preferred mechanical embodiment of the invention, showing a dual planar parallel stage concept.

Referring now to FIG. 10, a preferred dual parallel planar stage embodiment 61 is depicted showing an average-sized male user 20 ready to engage with the machine in order to show an overall view and sense of scale.

Figure 11:
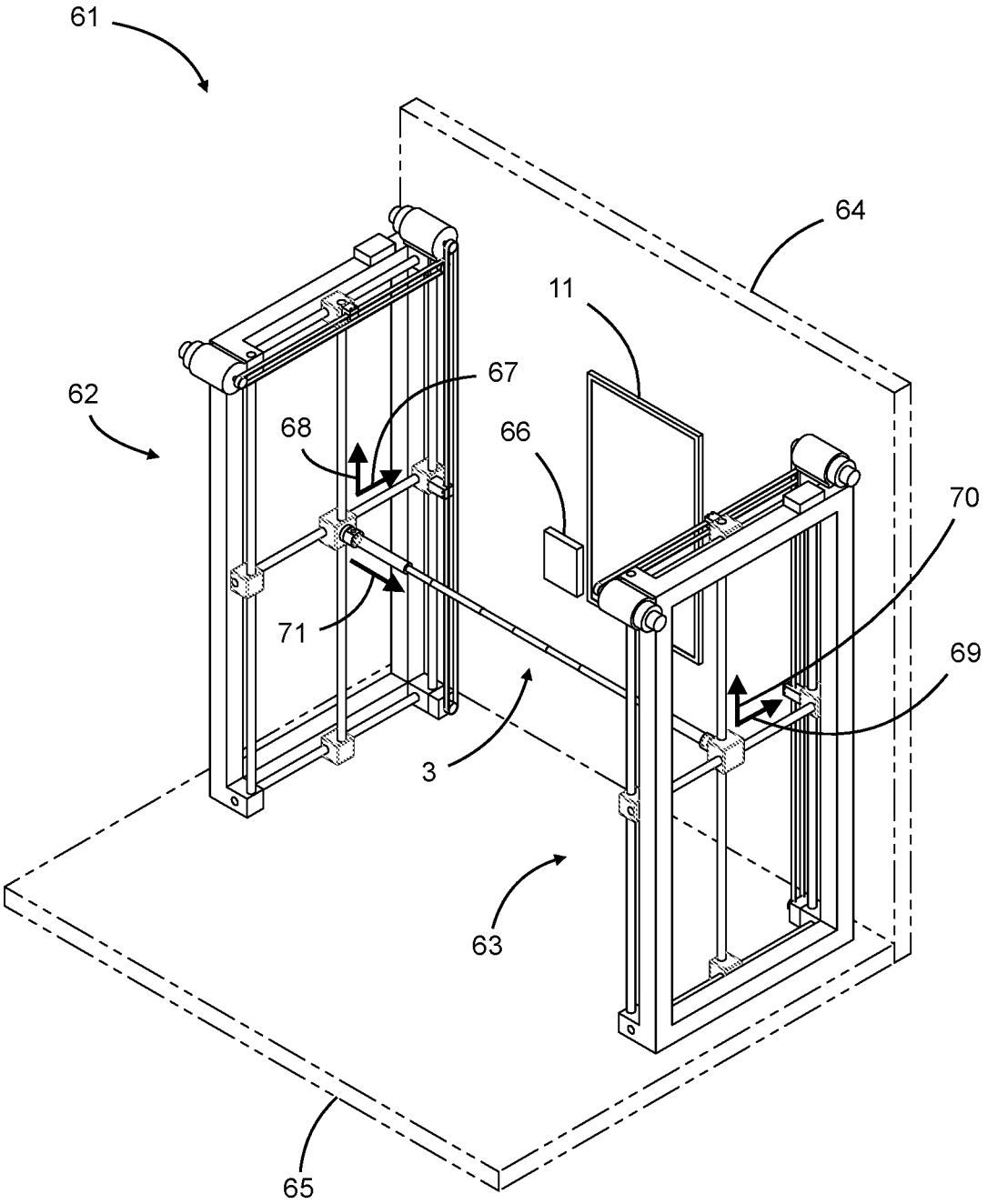
FIG. 11 illustrates the certain primary components and their positioning with the physical surroundings which might typically be found near the invention during its common usage and coordinate system definitions to clarify the description of certain preferred embodiments of the invention.

Referring now to FIG. 11, the preferred dual parallel planar stage embodiment of FIG. 10 is shown without the user in order to detail the major subsystems and define coordinate systems and directions. The preferred embodiment is composed of a left parallel planar stage 62 and a right parallel planar stage 63 installed such that both stages 62 and 63 are parallel to one another. It should be evident to those skilled in the relevant art that this installation can be accomplished in various embodiments by securably affixing or hingedly attaching the stages to any one or combination of: the wall 64, the floor 65, or a frame structure joining the two stages (not shown). Spanning between the two stages is a barbell accessory 3. An HMI 11 and processor 66 are shown mounted to the wall 64, however in other embodiments not depicted they could also be mounted to the floor 65, a frame structure, to either or both of the stages 62 and 63, or on a free-standing mount. In order to discuss motion of the stages and barbell accessory, coordinate directions are defined as shown with the X1 direction 67 and Y1 direction 68 being associated with the left parallel planar stage 62 and being parallel to the floor and Earth's gravity vector, respectively. The X2 direction 69 and Y2 direction 70 are associated with the right parallel planar stage 63 and are also parallel to the floor and Earth's gravity vector, respectively. The Z direction 71 is parallel to the axis of the barbell accessory 3. Note that power and communication cables would likely be visible between the processor 66 and HMI 11, processor 66 and left parallel planar stage 62, and processor 66 and right parallel planar stage 63, but for clarity in the drawing these cables are not depicted and should be evident to anyone skilled in the art.

Figure 12:
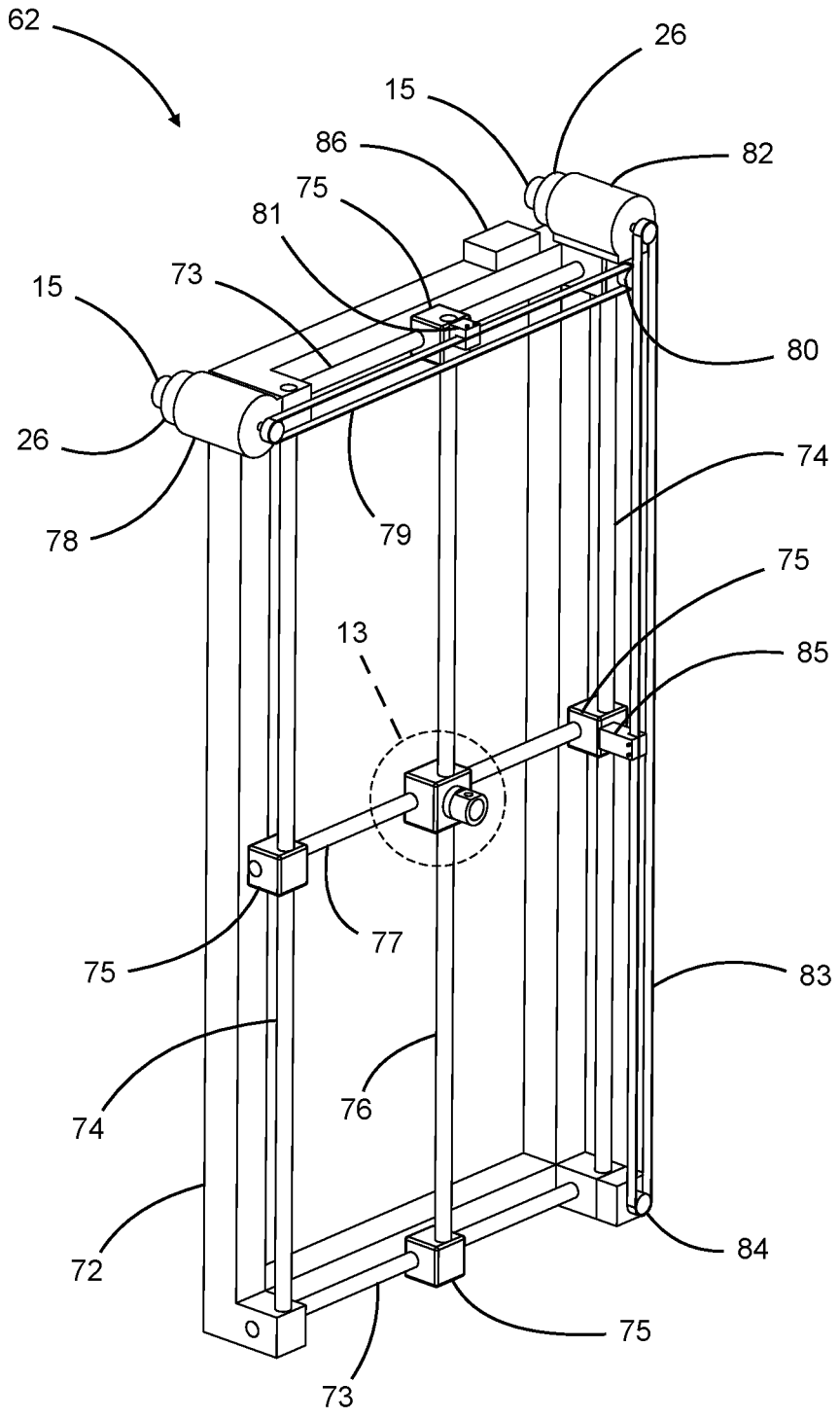
FIG. 12 illustrates certain components found in a planar parallel-stage embodiment of the invention.

Referring now to FIG. 12, detail of the left parallel planar stage 62 is depicted. Detail for only one of the stages is shown because in this embodiment the two parallel planar stages are simply mirror assemblies of one another. The stage depicted is comprised of a frame 72 to which two pairs of rods are mounted, specifically an upper and lower horizontal fixed X rod 73 and a left and right vertical fixed Y rod 74. A pair of linear carriages 75 ride upon each fixed X rod 73 which are also connected to a mobile Y rod 76. A pair of linear carriages 75 also ride upon each fixed Y rod 74, which are also connected to a mobile X rod 77. The mobile rods are in turn connected via a payload carriage 87 detailed at larger scale in FIG. 13. This mechanical arrangement is referred to as a parallel stage which allows all drive elements to be mounted to a fixed reference, in this case the frame 72. The X direction of the stage is driven by an X motor 78 whose output drive shaft is connected to an X belt 79. The return motion of the X belt 79 is effected by the X pulley 80 which is mounted to the frame 72. Force/motion is imparted to the X direction of the stage by a connection of the X belt 79 to the X belt clamp 81 which is in turn affixed to the linear carriage 75 riding on the upper fixed X rod 73. The Y direction of the stage is driven by an Y motor 82 whose output drive shaft is connected to a Y belt 83. The return motion of the Y belt is effected by the Y pulley 84 which is mounted to the frame 72. Force/motion is imparted to the Y direction of the stage by a connection of the Y belt 83 to the Y belt clamp 85 which is in turn affixed to the linear carriage 75 riding on the right fixed Y rod 74. Both motors are also shown with integrated brakes/clutches 26 and encoders 15 however this does not limit other means of measuring position/velocity or providing a controlled braking force such as being located on one or more of the rods. Finally, the controller 86 is shown mounted to the top of the frame 72 for convenient wiring proximity to the motors, however this does not preclude the controller 86 being located in other places, such as but not limited to, integrated into the motors themselves, located off of the stage, mounted to a structure connecting the planar stages, or integrated with the processor into a single controller/processor unit. Note that for clarity in the figure, power/communication cables are not shown.

Figure 13:
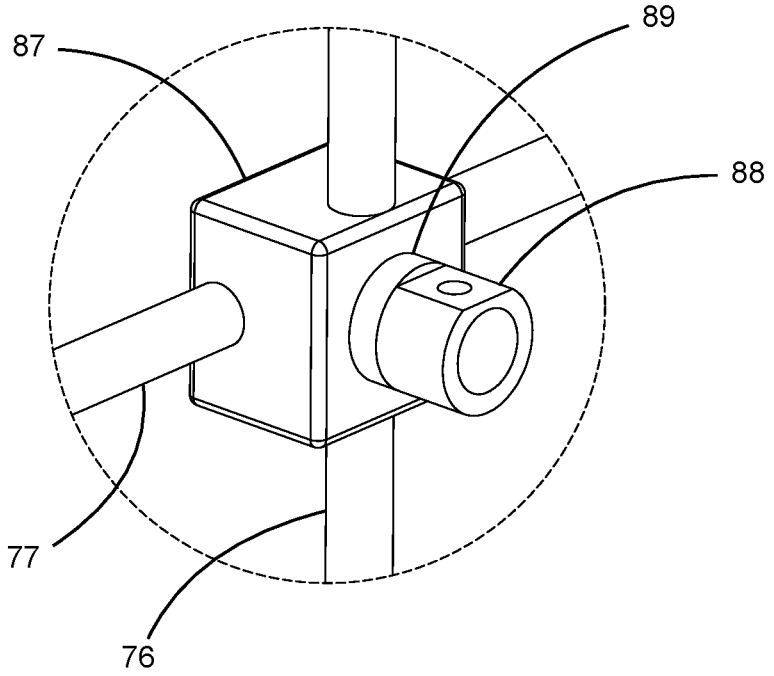
FIG. 13 illustrates a detailed view of the payload carriage, accessory union, and sensor components of a certain preferred embodiment of the invention.

Referring now to FIG. 13, the payload carriage 87 is shown slideably connecting the X mobile rod 77 and Y mobile rod 76. It is now clear that by actuating the motors, the payload carriage 87 can be controlled to move anywhere in the X-Y plane of the stage, hence producing planar motion. Further, an accessory union 88 is shown connected to the payload carriage 87 via a force/accelerometer sensor module 89. While the accessory union 88 is shown as the socket of a ball-and-socket style interface, it could be designed as any number of other "universal" style joints allowing for two degree-of-freedom pivoting of its mating accessory such as, but not limited to, universal joints or flexure couplings. The accessory union 88 could also be designed as the ball of a ball-and-socket interface. Note that for clarity in the figure as depicted, power/communication cables are not shown.

Figure 14:
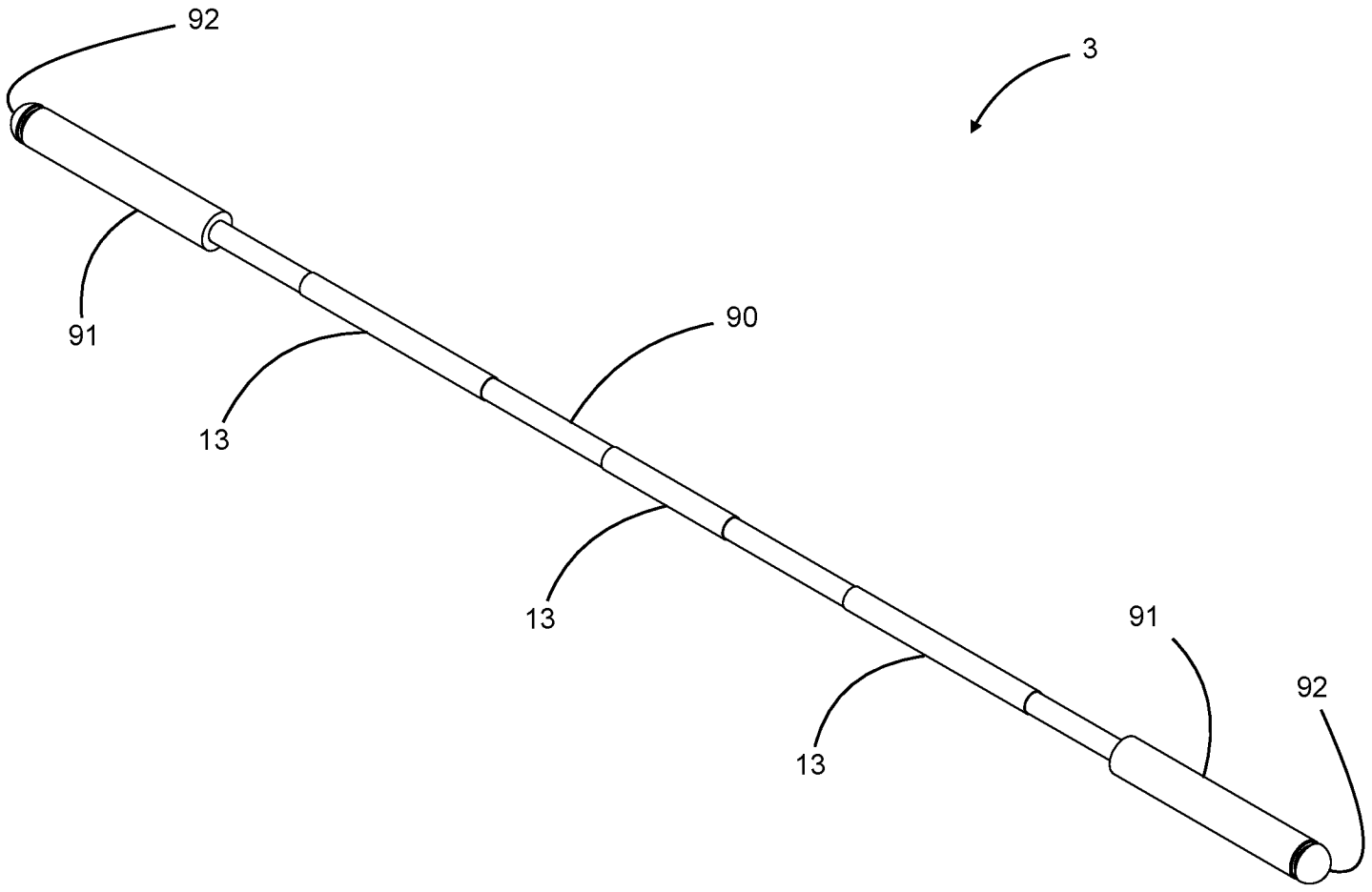
FIG. 14 illustrates the barbell accessory components of a certain preferred embodiment of the invention.

Referring now to FIG. 14 and referring back to FIGS. 11 and 13, the barbell accessory 3 is depicted being composed of a barbell shaft 90 which composes the majority of the length of the barbell accessory 3, an extendable collar 91 mounted on each end of the barbell shaft 90, an accessory union interface 92 affixed to the outboard end of each extendable collar 91, and three grip sensors 13 affixed to or integrated into the barbell shaft 90. The accessory union interface 92 is a mechanism allowing for the insertion into the stage's accessory union 88 and is shown as the ball side of a typical ball-and-socket interface. The extendable collar 91 is free to slide along the axis of the barbell shaft 90, effectively shortening or lengthening the full barbell accessory 3. This extension/retraction is required during operation of the invention since the dual planar stages 62 and 63 as depicted in FIG. 11 are a fixed distance apart yet the barbell accessory 3 must span between the two accessory unions even when they are not directly across from one another (the mathematically shortest distance), effectively allowing the barbell accessory 3 to produce roll and yaw positions as will be shown in FIGS. 15 and 16. The extendable collar 91 may be designed such that it simply slides over the barbell shaft 90, or it may be allowed to slide but be captured such that it cannot fall off of the barbell shaft 90, or it may be captured and spring loaded such that the barbell accessory 3 is at full extension when removed from the stage system. This spring-loaded option may be preferable in certain embodiments in order to produce a realistic barbell simulation or "feel" to the user. Finally, the grip sensors 13 are installed over or integrated into the barbell shaft 90 in order to provide a signal to the processor 66 in FIG. 11 that the user is engaging the barbell accessory 3. While three grip sensors 13 are shown, a minimum of one grip sensor 13 is required. The grip sensors 13 might be, but not limited to, any one or combination of the following technologies: piezoresistive films, strain gages, capacitive gauges. Wiring for the grip sensors 13 is not shown and can be, but not limited to, any one or combination of the following: routed through the barbell shaft 90 (if hollow), affixed along the outer diameter length of the barbell shaft 90, integrated into the body of the barbell shaft 90 such as during the layup of carbon fiber tubing, or contain the ability to wirelessly communicate.

Figure 15:
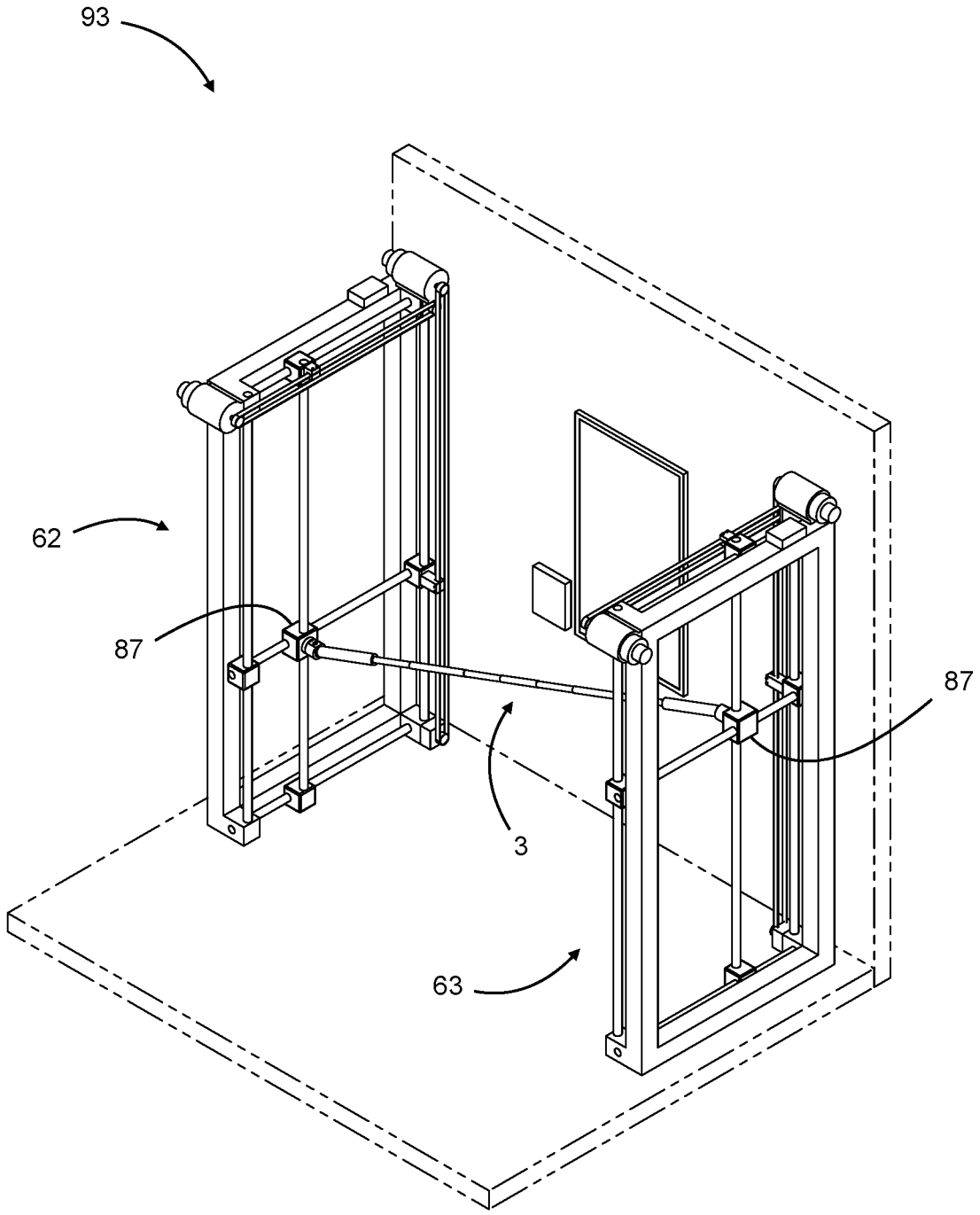
FIGS. 15 and 16 illustrate the positioning of a simulated barbell in certain preferred embodiments during a combined roll and yaw motion.

Referring now to FIG. 15, a perspective view 93 showing roll and yaw of the barbell accessory 3 is depicted. With the payload carriage 87 of the left parallel planar stage 62 in the negative X1 direction and negative Y1 direction, and the payload carriage 87 of the right parallel planar stage 63 in the positive X2 direction and positive Y2 direction, a roll and yaw position is produced in the barbell accessory 3. More detailed directional views of FIG. 15 are shown in FIG. 16.

Figure 16A:
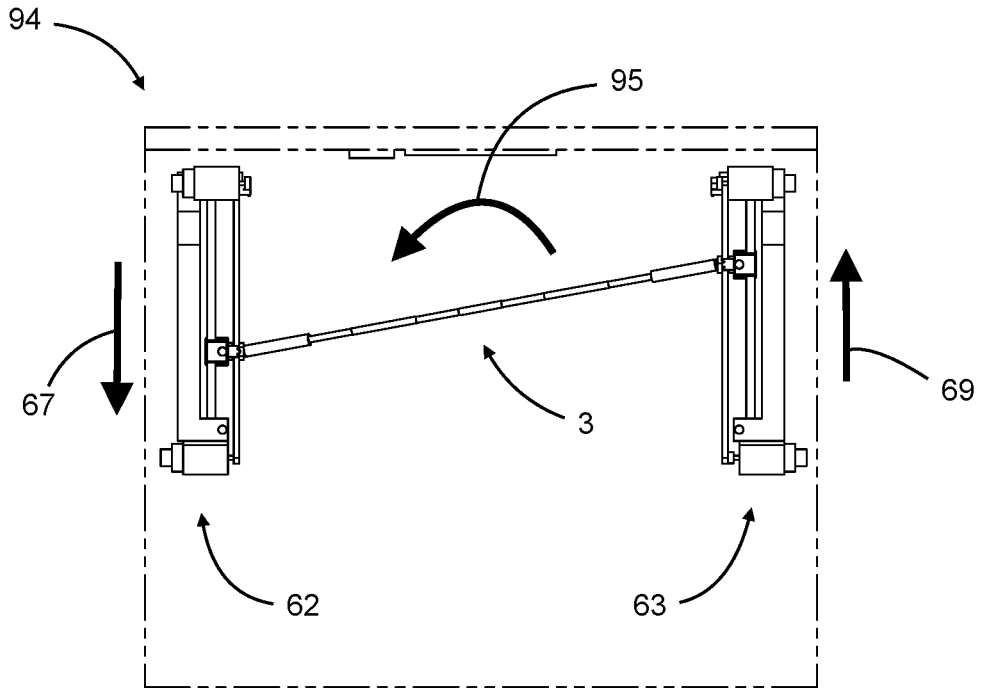

For more clarity, FIG. 16A depicts the top view showing the yaw direction 94 of the barbell accessory 3. This top view clearly shows the left parallel planar stage 62 having moved in the negative X1 direction 67 and the right parallel planar stage 63 having moved in the positive X2 direction 69 resulting in an overall motion of the barbell accessory 3 in the yaw direction 95.

Figure 16B:
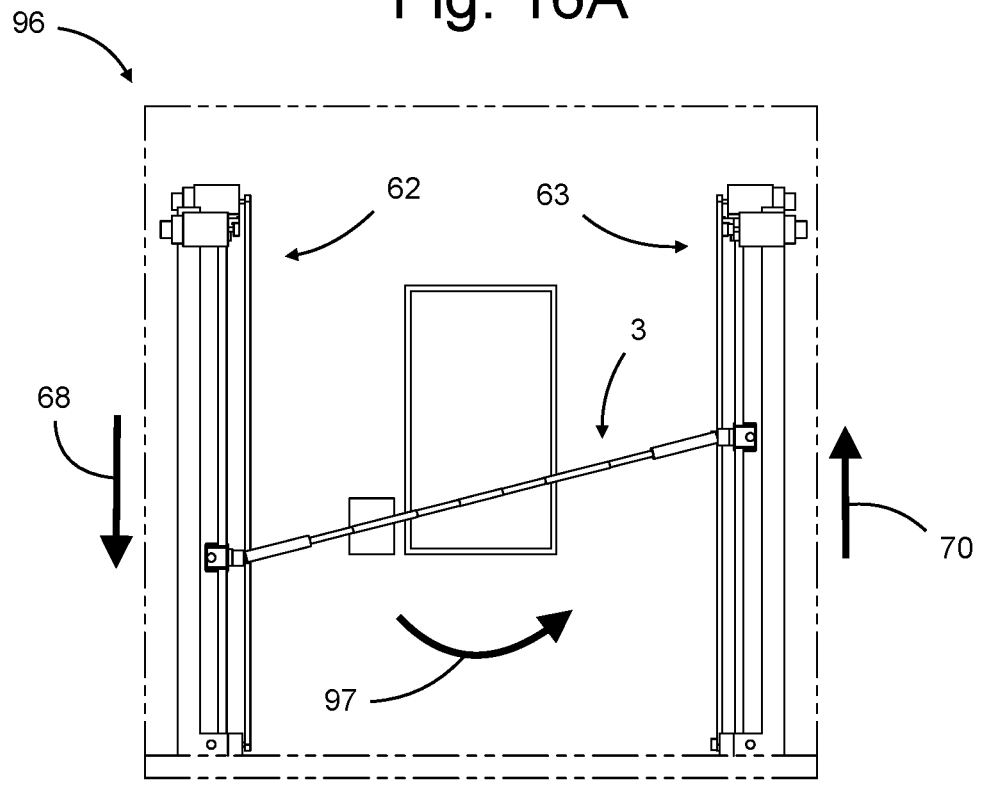

For more clarity, FIG. 16B depicts the top view showing the roll direction 96 of the barbell accessory 3. This top view clearly shows the left parallel planar stage 62 having moved in the negative Y1 direction 68 and the right parallel planar stage 63 having moved in the positive Y2 direction 70 resulting in an overall motion of the barbell accessory 3 in the roll direction 97.

Figure 17:
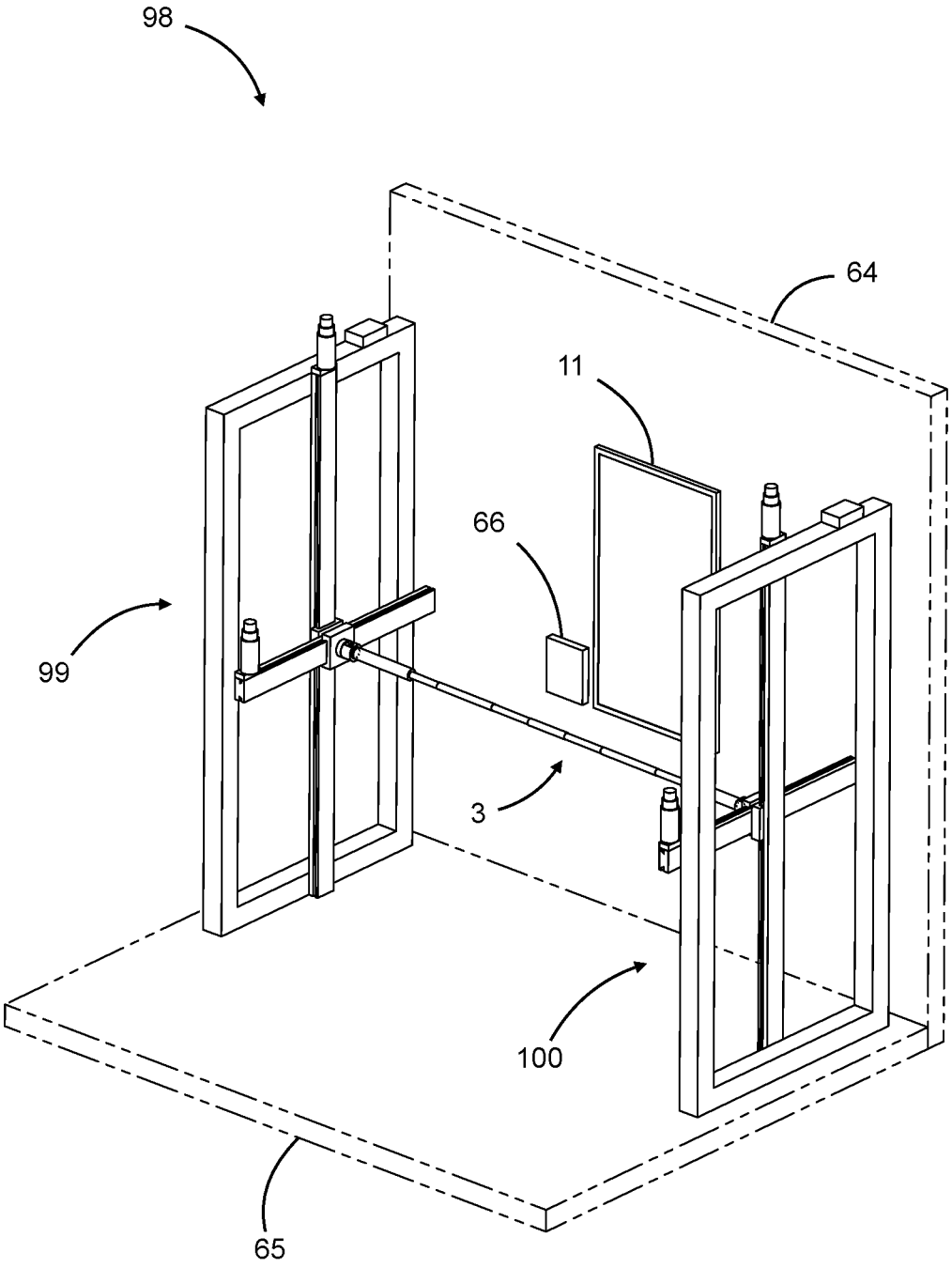
FIG. 17 illustrates an overview preferred embodiment of a serial stage embodiment of the invention.

Referring now to FIG. 17, a preferred dual serial planar stage embodiment 98 is depicted. The preferred embodiment is composed of a left serial planar stage 99 and a right serial planar stage 100 installed such that both stages 99 and 100 are parallel to one another and with coordinates and directions defined analogous to those in FIG. 11. This installation could be accomplished by affixing the stages to any one or combination of the wall 64, the floor 65, and a frame structure joining the two stages (not shown, but apparent to a person skilled in the art of exercise equipment construction). Spanning between the two stages 99 and 100 is a barbell accessory 3. An HMI 11 and processor 66 are shown mounted to the wall 64, however they could also be mounted to the floor 65, a frame structure, to either of the stages, or on a free-standing mount. Note that power and communication cables would likely be visible between the processor 66 and HMI 11, processor 66 and left serial planar stage 99, and processor 66 and right serial planar stage 100, but for clarity these cables are not depicted.

Figure 18:
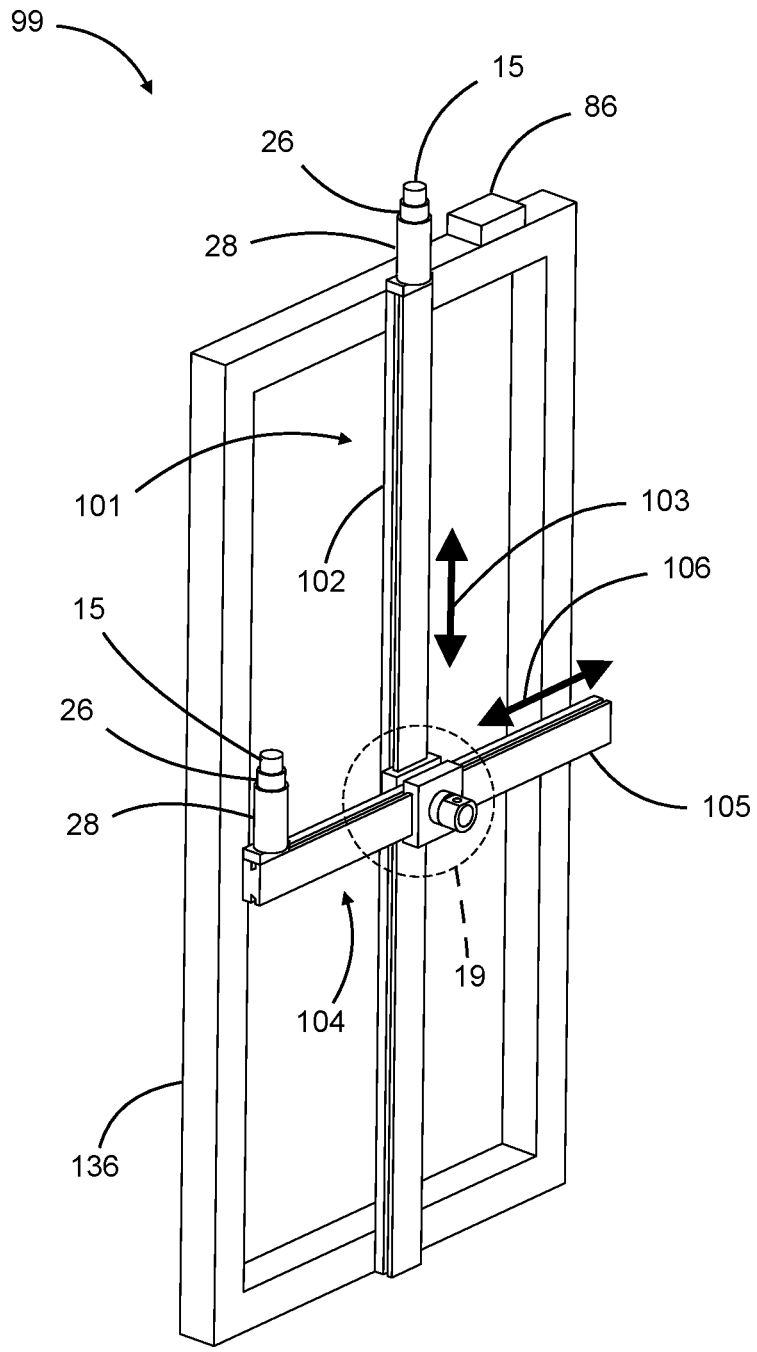
FIG. 18 illustrates certain components of a serial stage preferred embodiment of the invention.

Referring now to FIG. 18, detail of the left serial planar stage 99 is depicted. Detail for only one of the stages is shown because they are simply mirror assemblies of one another. The serial stage is comprised of a frame 136 to which a linear Y stage 101 is mounted, the Y stage 101 being comprised of a Y rail 102, a Y carriage, shown detailed at larger scale in FIG. 19, which rides upon the Y rail 102 to produce Y direction motion 103, and a Y motor 28. An X stage 104 is mounted to the Y carriage oriented such that it is perpendicular to the Y stage 101. The X stage 104 is comprised of an X rail 105, an X carriage, shown detailed at larger scale in FIG. 19, which rides upon the X rail 105 to produce X direction motion 106, and an X motor 28. This mechanical arrangement is referred to as a serial stage because stages are simply stacked "serially" upon one another to produce multiple degree-of-freedom motion. While simpler in mechanical construction than the parallel stage depicted earlier, the serial approach requires the base stage, in this case the Y stage 101, to carry the weight of and move the inertia of the subsequent stage(s) mounted to it, in this case the X stage 104. The X stage 104 and Y stage 101 could be of any common construction to those skilled in the art such as, but not limited to: leadscrew/ballscrew stage, belt driven stage, cable driven stage, linear motor, pneumatic stage, or hydraulic stage. Both motors 28 are also shown with integrated brakes/clutches 26 and encoders 15, however this does not limit other means of measuring position/velocity or providing a controlled braking force. Finally, the controller 86 is shown mounted to the top of the frame 136 for convenient wiring proximity to the motors, however this does not preclude the controller 86 being located in other places, such as but not limited to, integrated into the motors themselves, located off of the serial stage, mounted to a structure connecting the planar stages, or integrated with the processor into a single controller/processor unit. Note that for clarity, power/communication cables are not shown.

Figure 19:
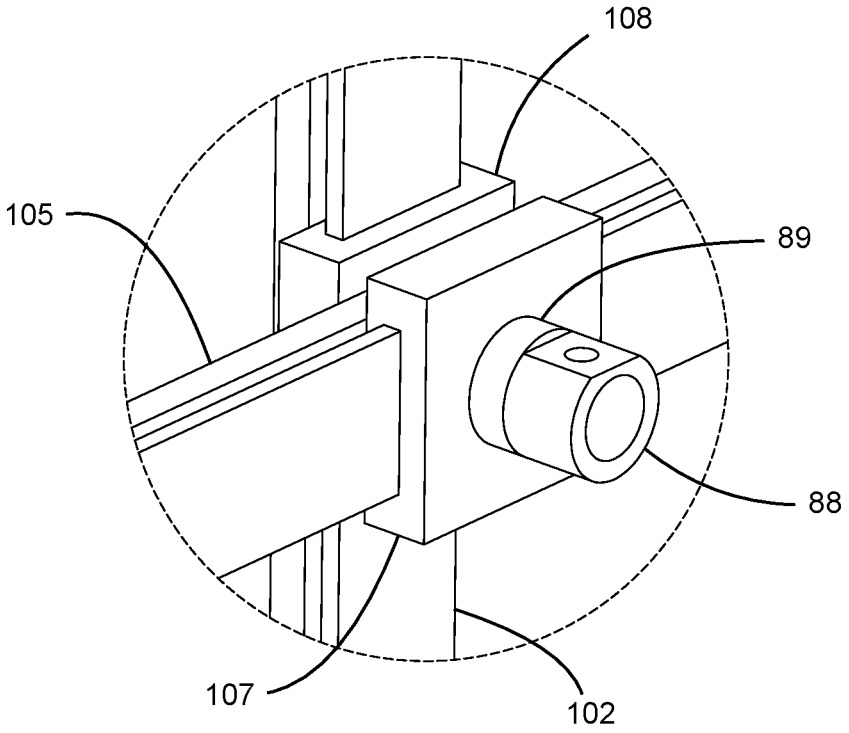
FIG. 19 illustrates a detailed view of the payload carriage, accessory union, and sensor components of a certain preferred embodiment of the invention.

Referring now to FIG. 19 and back to FIG. 13, the Y carriage 108 movable on the Y rail 102 is shown also mounted to the X rail 105, with the X carriage 107 acting also as a payload carriage 87. It is now clear that by actuating the motors, the payload carriage 87 can be controlled to move anywhere in the X-Y plane of the stage, hence producing planar motion. Further, an accessory union 88 is shown connected to the X carriage 107 via a force/accelerometer sensor module 89. While the accessory union 88 is shown as the socket of a ball-and-socket style interface, it could be designed as any number of other "universal" style joints allowing for two degree-of-freedom pivoting of its mating accessory such as, but not limited to, universal joints or flexure couplings. The accessory union 88 could also be designed as the ball of a ball-and-socket interface. Note that for clarity power/communication cables are not shown.

Figure 20A:
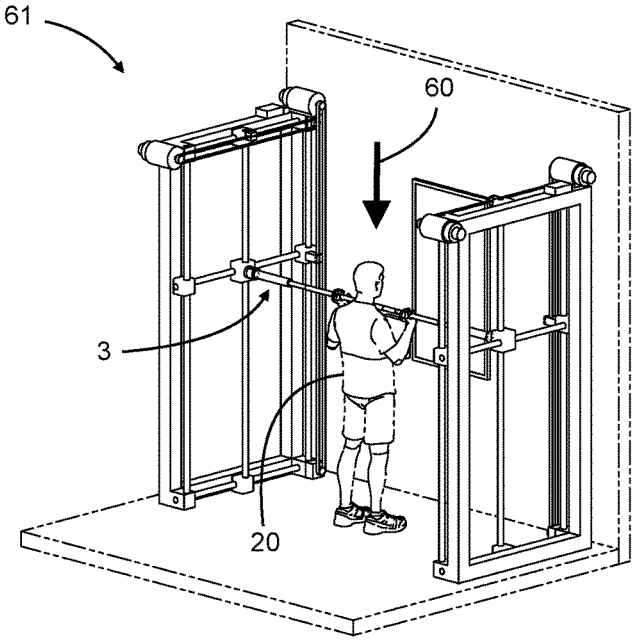
FIG. 20 illustrates a user performing a standard overhead/military press using a preferred embodiment of the invention.
Figure 20B:
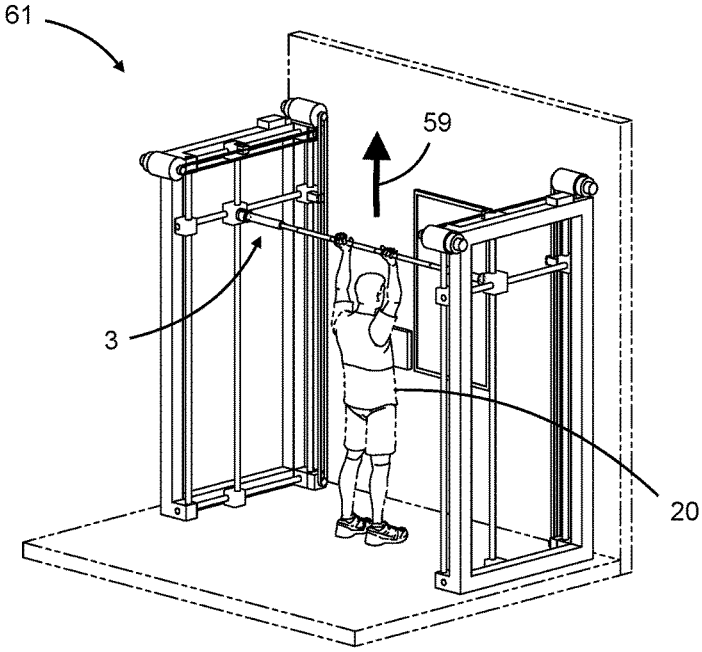

Referring now to FIG. 20, an overhead/military press exercise use of a preferred embodiment is depicted. The dual parallel planar stage embodiment 61 is shown with a user 20 engaging the barbell accessory 3. FIG. 20A depicts the user 20 in the lowered or eccentric motion 60 part of the exercise. FIG. 20B depicts the user 20 in the extended or concentric motion 59 part of the exercise.

Figure 21A:
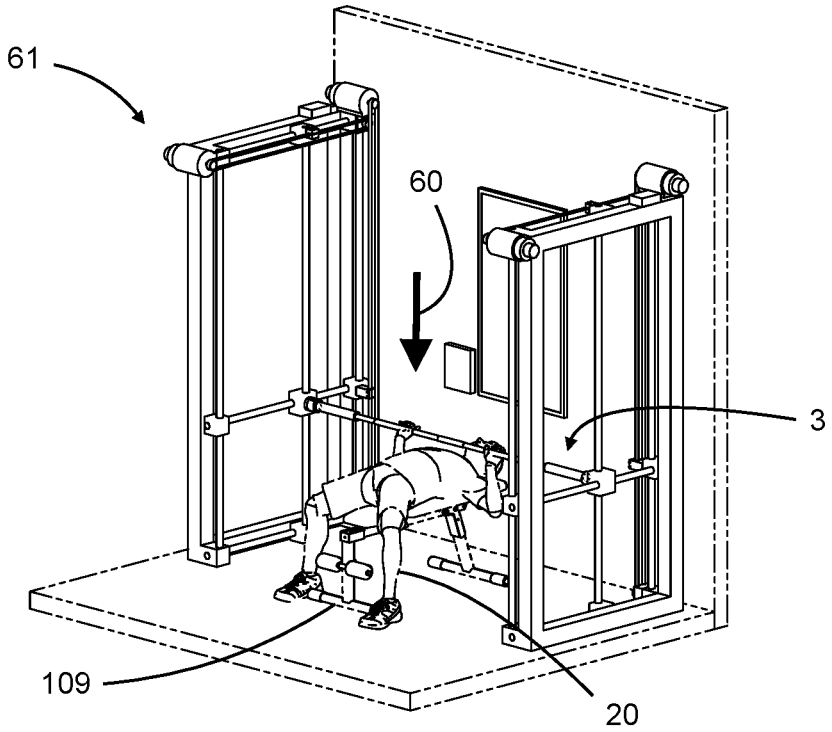
FIG. 21 illustrates a user performing a standard bench press using a preferred embodiment of the invention.
Figure 21B:
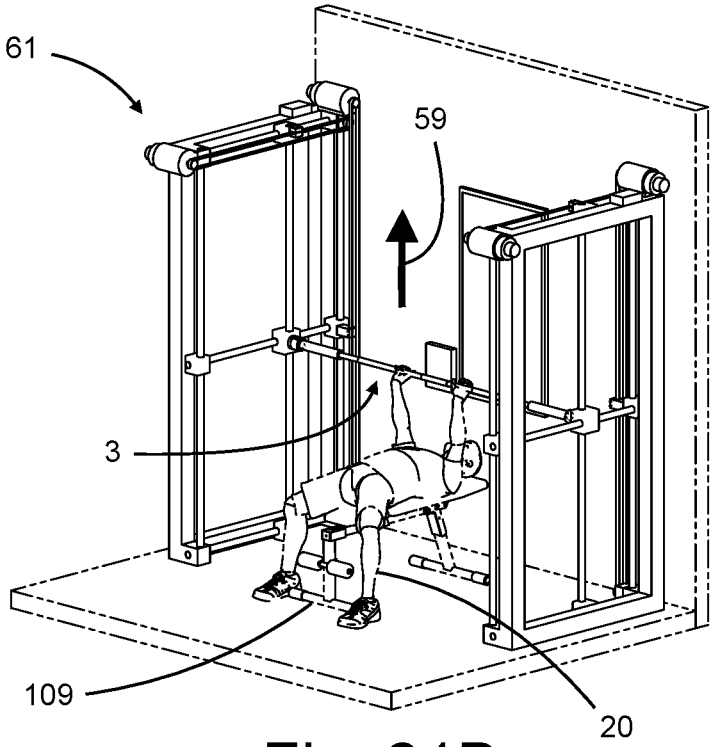

Referring now to FIG. 21, a bench press exercise use of a preferred embodiment is depicted. The dual parallel planar stage embodiment 61 is shown with a user 20 engaging the barbell accessory 3 while lying, face up, on an exercise bench 109. FIG. 21A depicts the user 20 in the lowered or eccentric motion 60 part of the exercise. FIG. 21B depicts the user 20 in the extended or concentric motion 59 part of the exercise. While the exercise bench 109 is shown as a standard, stand-alone piece of off-the-shelf equipment, it could also be integrated into the invention as a stowable component able to fold up against the wall when not in use. This stowable version of the exercise bench could be mounted to the any one of: the floor, the wall, a frame structure connecting the left and right stages.

Figure 22:
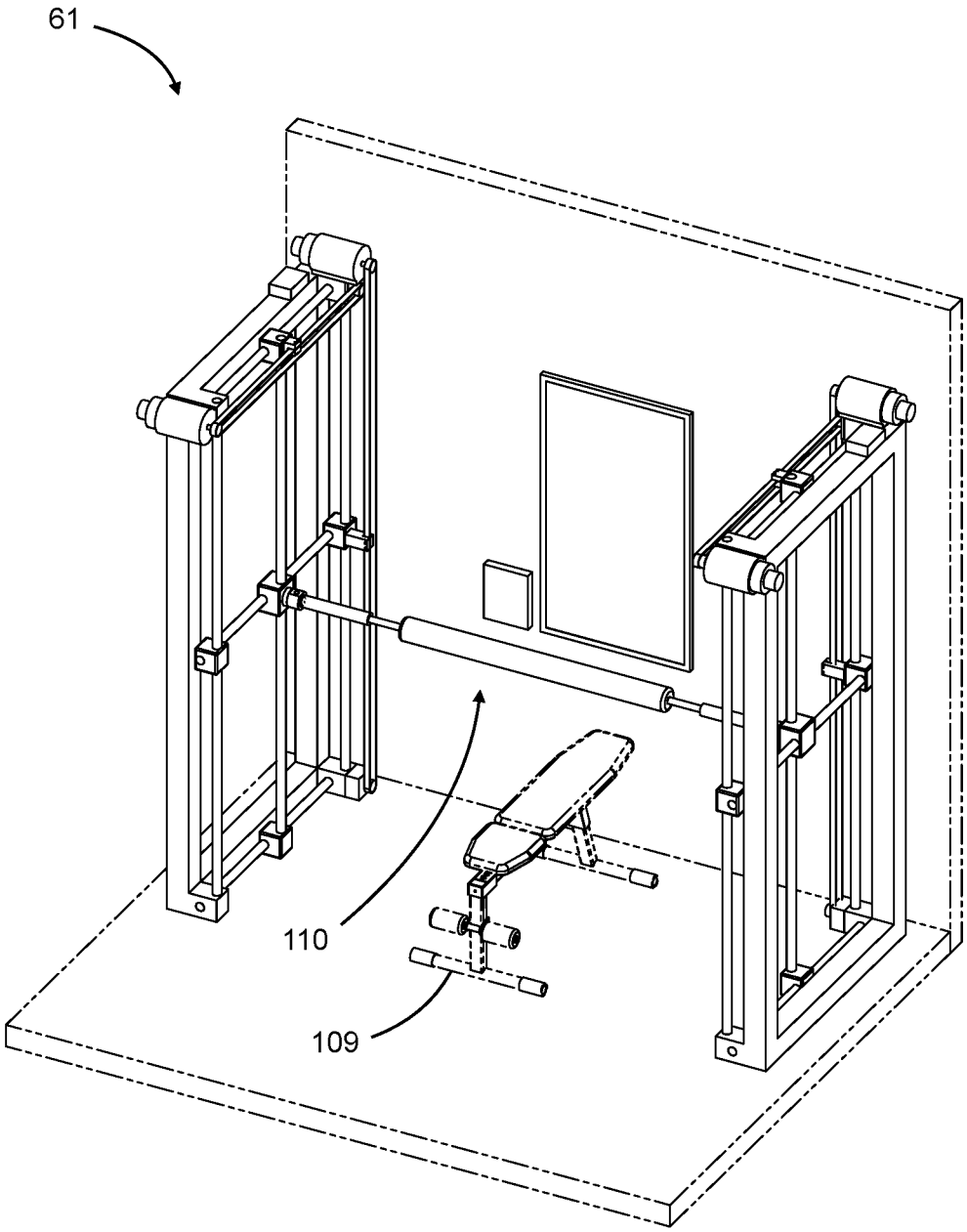
FIG. 22 illustrates an embodiment of an abs and back accessory on a dual parallel planar stage embodiment of the invention.

Referring now to FIG. 22, a preferred embodiment of an abs/back accessory 110 is depicted. The dual parallel planar stage embodiment 61 is shown with an exercise bench 109 and abs/back accessory 110. The preferred embodiment shown is composed of the barbell accessory with a removably affixed pad that simply slides over and is centered upon the barbell accessory. The pad for the abs/back accessory 110 could comprise any of, but not limited to, the following: open or closed cell foam, rubber, cloth, enclosed gel.

Figure 23A:
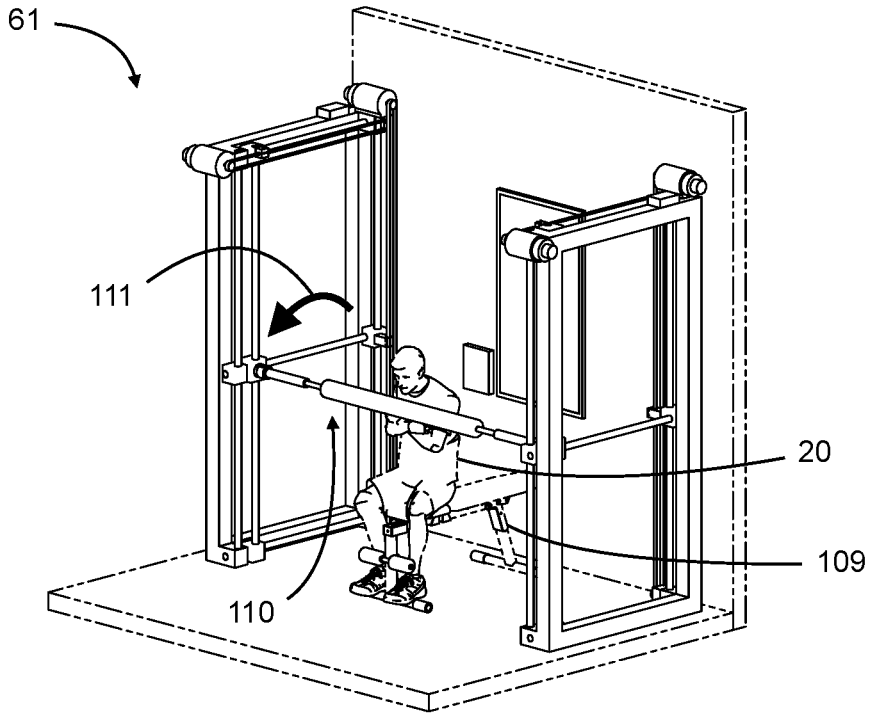
FIG. 23 illustrates a user performing an abdominal exercise using an embodiment of an abs/back accessory on a dual planar parallel stage embodiment of the invention.
Figure 23B:
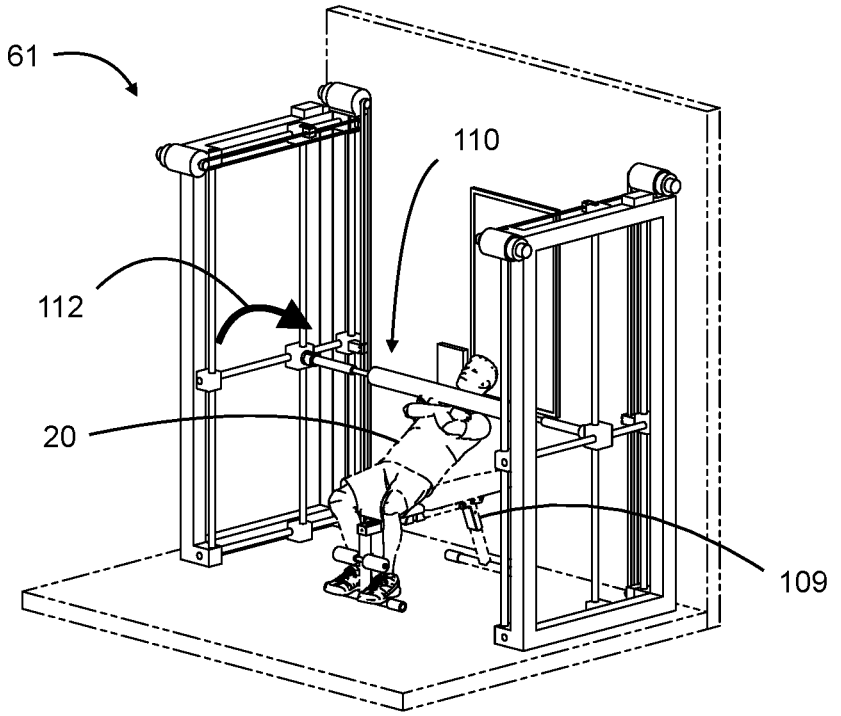

Referring now to FIG. 23, an abdominal ("abs") exercise use of a preferred embodiment is depicted. The dual parallel planar stage embodiment 61 is shown with a user 20 sitting on an exercise bench 109 and engaging the abs/back accessory 110. FIG. 23A depicts the user 20 in the concentric motion part of the exercise. FIG. 23B depicts the user 20 in the eccentric motion part of the exercise. For this exercise to properly simulate a standard abs functional exercise machine, the FSM would be programmed for an abs exercise mode restricting the abs/back accessory 110 trajectory as follows: 1) the left and right stage motion is controlled and synchronized such that the abs/back accessory 110 stays parallel to the floor and wall (no yaw or roll permitted), and 2) the left and right stage motion is controlled to a specific arc-shaped path that ensures the abs/back accessory 110 stays in approximate constant contact with an imaginary line between the front of the user's 20 shoulders while applying the desired exercise force along the path to the user 20. This arc-shaped path is shown in FIG. 23A as an abs exercise path in the concentric direction 111 and in FIG. 23B as an abs exercise path in the eccentric direction 112. While this path could be programmed to be user-independent, a preferred mode would be for the path to be algorithmically generated and optimized to the user's biomechanics.

Figure 24A:
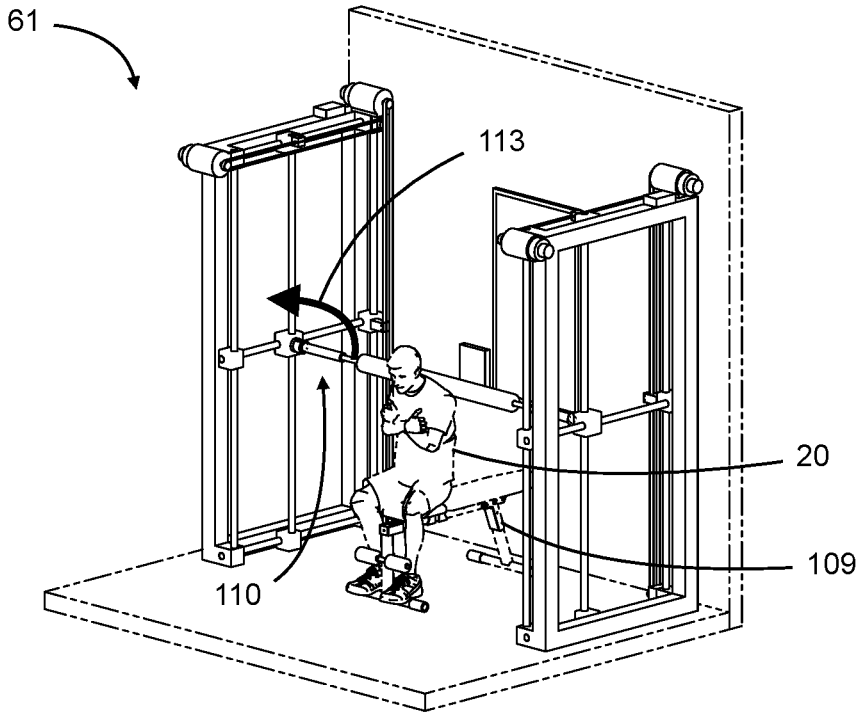
FIG. 24 illustrates a user performing a back exercise using an embodiment of an abs/back accessory on a dual planar parallel stage embodiment of the invention.
Figure 24B:
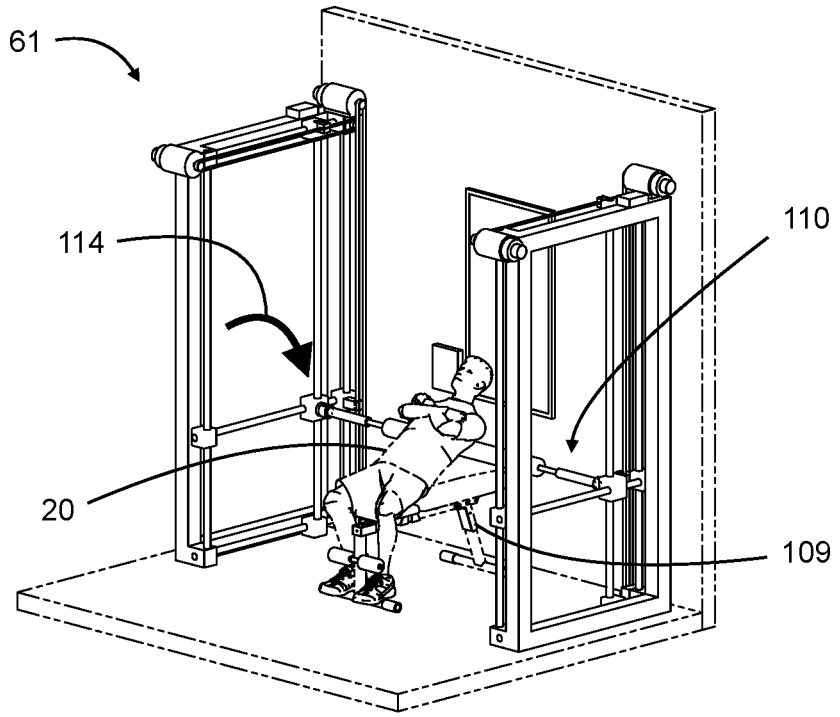

Referring now to FIG. 24, a back exercise use of a preferred embodiment is depicted. The dual parallel planar stage embodiment 61 is shown with a user 20 sitting on an exercise bench 109 and engaging the abs/back accessory 110. FIG. 24A depicts the user 20 in the eccentric motion part of the exercise. FIG. 24B depicts the user 20 in the concentric motion part of the exercise. Similar to the abs exercise, for this exercise to properly simulate a standard back functional exercise machine, the FSM would be programmed for a back exercise mode restricting the abs/back accessory 110 trajectory as follows: 1) the left and right stage motion is controlled and synchronized such that the abs/back accessory 110 stays parallel to the floor and wall (no yaw or roll permitted), and 2) the left and right stage motion is controlled to a specific arc-shaped path that ensures the abs/back accessory 110 stays in approximate constant contact with an imaginary line between the user's 20 shoulder blades while applying the desired exercise force along the path in opposition to the user 20. This arc-shaped path is shown in FIG. 24A as a back exercise path in the eccentric direction 113 and in FIG. 24B as a back exercise path in the concentric direction 114. While this path could be programmed to be user-independent, a preferred mode would be for the path to be algorithmically generated and optimized to the user's biomechanics.

Figure 25:
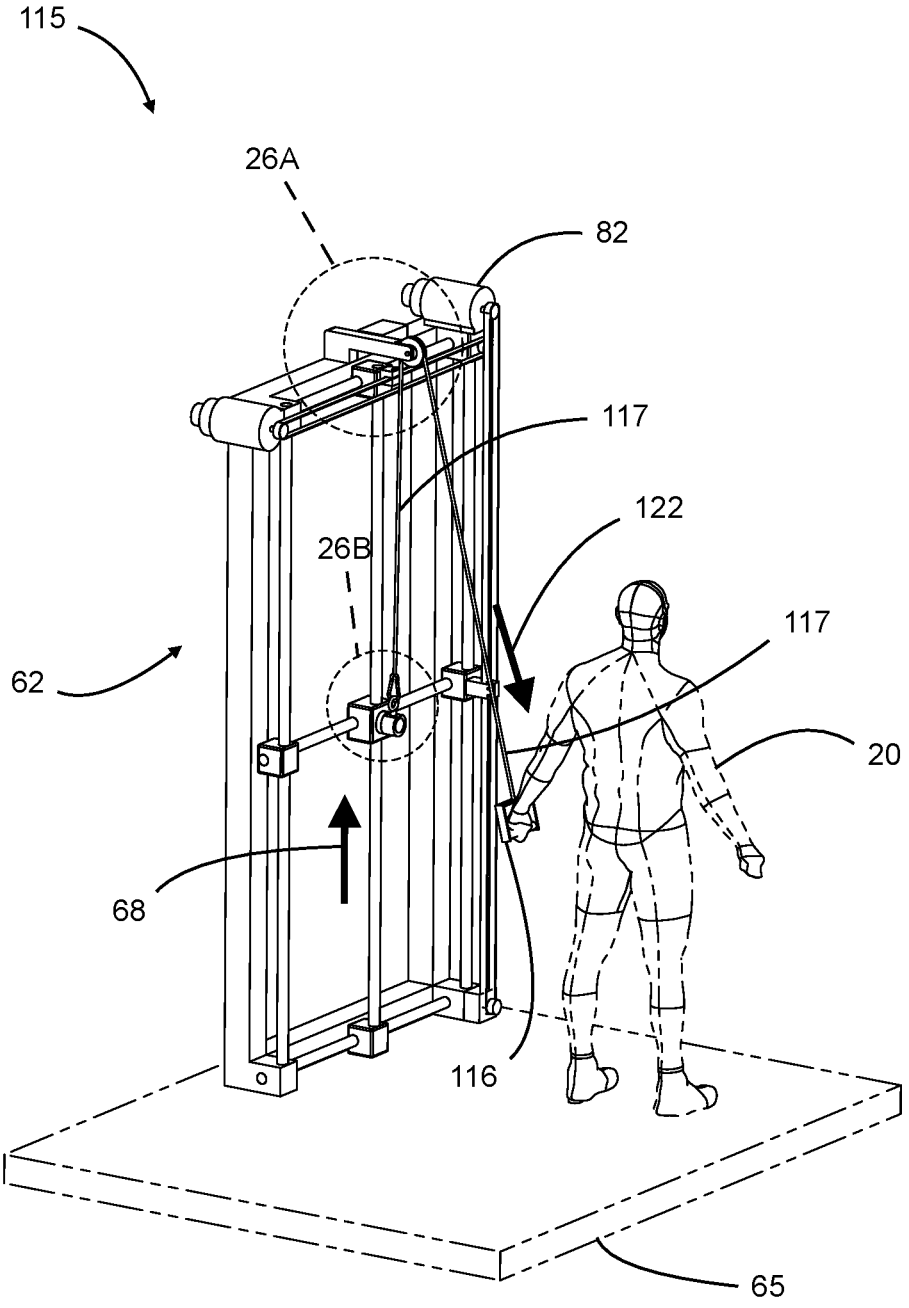
FIG. 25 illustrates an embodiment of a cable pull accessory on a single parallel planar stage embodiment of the invention.
Figure 26A:
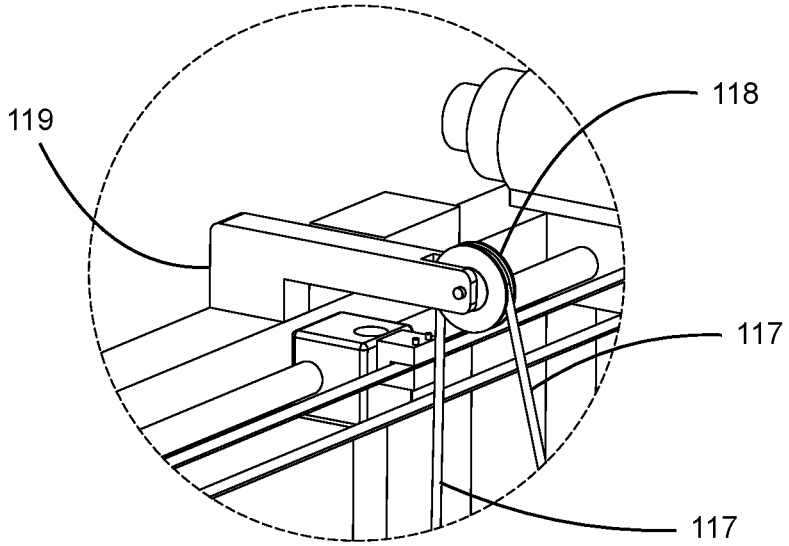
FIG. 26 illustrates a detailed view of the certain components of a cable pull accessory embodiment of the invention.
Figure 26B:
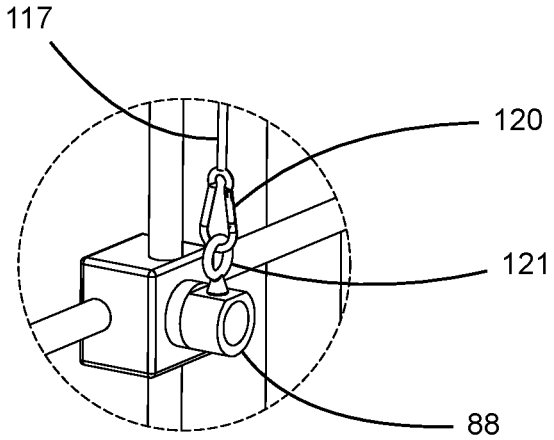

Referring now to FIG. 25, a preferred embodiment of a cable pull accessory 115 is depicted. With the barbell accessory removed, the left parallel planar stage 62 is shown with the user 20 engaging a cable pull accessory 115 comprised of a handle 116 removably affixed to one end of a cable 117 and the other end of the cable 117 attached to the planar stage 62. While only one planar stage 62 is depicted, clearly this cable pull accessory 115 could be attached to two planar stages to accomplish dual cable pull exercises. Referring now to the magnified view of FIG. 26A, the cable 117 is directed through a cable pulley 118 which is mounted via a cable pulley mount 119. Referring now to the magnified view of FIG. 26B, the cable 117 is attached to the accessory union 88 via a cable connector 120 depicted as, but not limited to, a standard carabiner style fastener which is in turn clipped to the cable connector receptacle 121, depicted as, but not limited to, a standard eyebolt fastener, which is in turn rigidly affixed to the stage's accessory union 88. Referring again to FIG. 25, in this preferred embodiment, the stage is set to a mode that locks the motion of the X direction such that when the user 20 engages the handle 116 in the cable pull direction 122 the stage moves in the Y1 direction 68, and the Y motor 82 is engaged to provide the appropriate resistance force to the user 20. While this embodiment depicts a simple, single, centered pulley arrangement, those skilled in the art will recognize the pulley 118 and pulley mount 119 can be located in many locations on the stage, including the bottom and sides, be comprised of multiple pulleys, including compound pulley systems, and utilize either or both stage directions. While this embodiment depicts a simple removably affixed handle 116 for the user 20 to grip, those skilled in the art will recognize the handle 116 could be any one of a number of standard cable pull handle attachments such as, but not limited to: tricep rope, rotating straight bar, lat pull-down bar, v-shaped bar, or double D handle.

Figure 27:
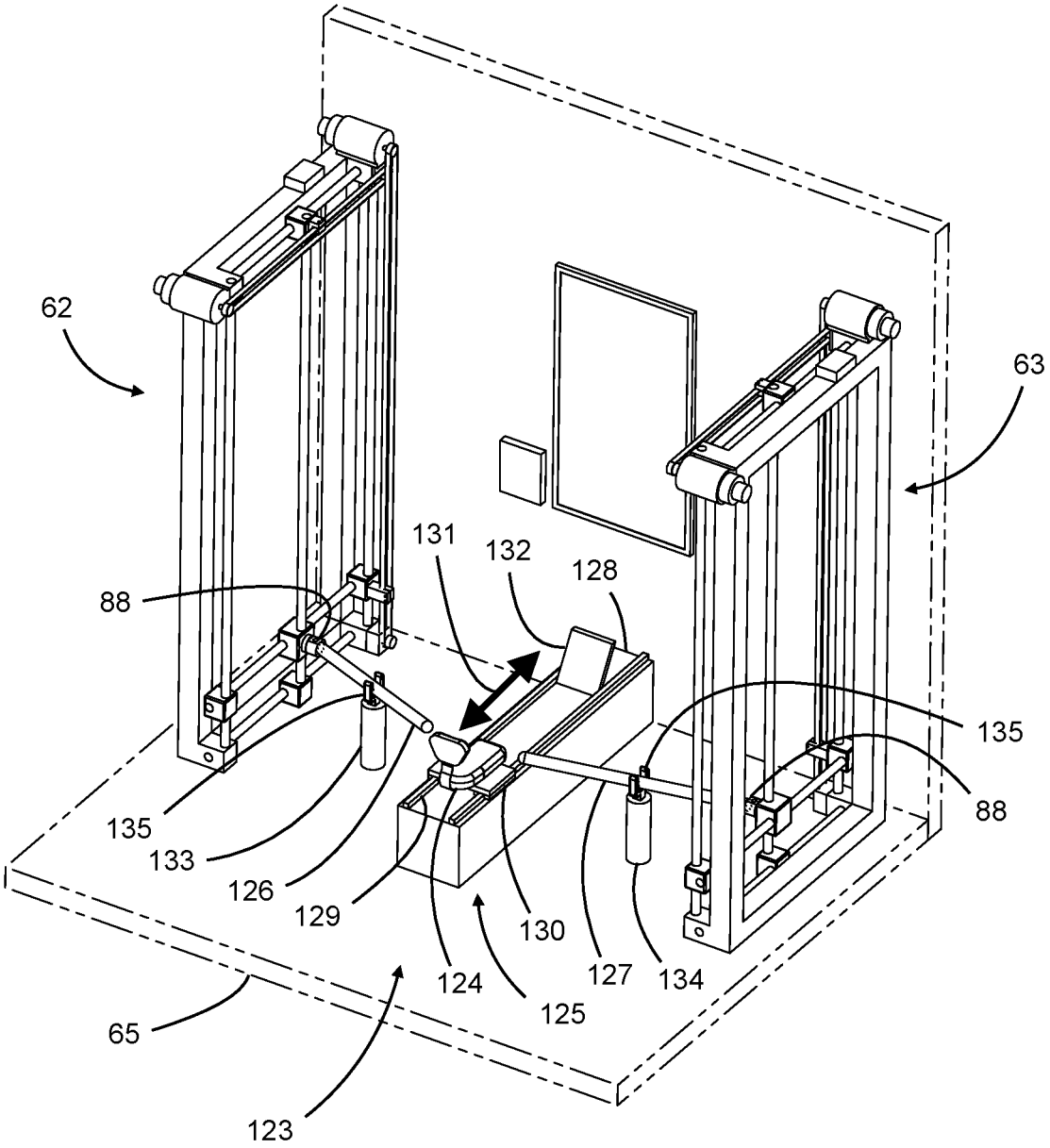
FIG. 27 illustrates an embodiment configuration of the invention to simulate a rowing machine using a dual parallel planar stage embodiment of the invention.

Referring now to FIG. 27, a preferred embodiment of a rowing machine accessory 123 is depicted. The rowing machine accessory 123 makes use of the FSM capability of the invention to produce a realistic simulation of rowing for the user while sitting in the seat 124 of the row seat assembly 125 and engaging the left oar 126 and right oar 127. The preferred embodiment consists of a row seat assembly 125 centered between the left parallel planar stage 62 and the right parallel planar stage 63. The row seat assembly 125 comprises a seat platform 128 affixed to the floor 65, one or more seat rails 129 mounted to the top of the seat platform 128, a seat 124 mounted to a seat carriage 130 which is slidingly attached to the seat rails 129 such that a sliding motion 131 of the seat 124 is achieved, and a foot rest 132 rigidly affixed to the end of the seat platform 128 opposite the seat 124. To the left of the row seat assembly 125 is the left oar pivot 133, the bottom of which is affixed to the floor 65, the top of which houses a standard u-shaped oar pivot mechanism 135 in which the left oar 126 rests. The left oar 126 is further attached on one end to the accessory union 88 of the left parallel planar stage 62. The free end of the left oar 126 is engaged by the user 20 during the rowing simulation exercise. To the right of the row seat assembly 125 is a similar right oar pivot 134, the bottom of which is affixed to the floor 65, the top of which houses a standard u-shaped oar pivot mechanism 135 in which the right oar 127 rests. The right oar 127 is further attached on one end to the accessory union 88 of the right parallel planar stage 63. The free end of the right oar 127 is engaged by the user 20 during the rowing simulation exercise. While the preferred embodiment shows the left oar pivot 133 and right oar pivot 134 mounted to the floor 65, they could also be mounted to a frame structure connected to the row seat assembly 125 such that the full rowing machine accessory could be moved in and out of the stage as a single unit once the left oar 126 and right oar 127 have been disconnected from the respective accessory unions 88.

The foregoing description of the embodiments, along with the provided drawings, has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. An exercise machine comprising:

a stage, the stage having a planar configuration and a frame, the stage comprising a Y rod having a configuration oriented in a Y coordinate direction, the Y rod being mounted on the frame for movement of the Y rod in a X coordinate direction, the Y coordinate direction and the X coordinate direction being mutually perpendicular, and the stage comprising a X rod having a configuration oriented in the X coordinate direction, the X rod being mounted on the frame for movement of the X rod in the Y coordinate direction;

a payload carriage attached to the Y rod and the X rod and supported on the frame by the Y rod and the X rod, the payload carriage being movable on the frame in the planar configuration of the stage, the payload carriage being movable in horizontal movements relative to the frame and in vertical movements relative to the frame;

an accessory union on the payload carriage; and an exercise accessory, the exercise accessory being removably attachable to the accessory union with the exercise accessory removably attached to the accessory union being movable relative to the payload carriage.

2. The exercise machine of claim 1, further comprising:

the stage being a first stage;

the frame being a first frame;

the payload carriage being a first payload carriage;

the accessory union being a first accessory union;

a second stage, the second stage having a planar configuration and a second frame;

a second payload carriage attached to and supported on the second frame, the second payload carriage being movable on the second frame in the planar configuration of the second stage, the second payload carriage being movable in horizontal movements relative to the second frame and in vertical movements relative to the second frame; and a second accessory union on the second payload carriage.

3. The exercise machine of claim 2, further comprising:

the planar configuration of the first stage and the planar configuration of the second stage being parallel.

4. The exercise machine of claim 2, further comprising:

the exercise accessory being removably attachable to the second accessory union with the exercise accessory removably attached to the second accessory union being movable relative to the second payload carriage.

5. The exercise machine of claim 1, further comprising:

a horizontal rail attached to and supported on the frame, the horizontal rail being movable in vertical movements on the frame;

a vertical rail attached to and supported on the frame, the vertical rail being movable in horizontal movements on the frame; and the payload carriage attached to and supported on the horizontal rail and the vertical rail.

6. A method for controlling the operation of an exercise machine comprising:

accepting certain input instructions from a user via a human machine interface;

transmitting the input instructions to a processor;

receiving the input instructions from the human machine interface into the processor;

constraining the motion of at least one payload carriage carrying an accessory union with a removably affixed exercise accessory along a desired path on at least one stage of the exercise machine;

controlling the motion of the payload carriage within the desired path on the at least one stage of the exercise machine with a driver mechanism;

the at least one stage of the exercise machine comprising a frame, the at least one stage comprising a Y rod mounted on the frame for movement of the Y rod in a X coordinate direction and a X rod mounted on the frame for movement of the X rod in a Y coordinate direction, the Y rod and the X rod being connected to the payload carriage whereby the payload carriage is moved relative to the frame along the desired path in response to movement of the Y rod and the X rod;

sensing data comprising any one or more of the position, velocity, acceleration, and force of the payload carriage at or near the position of the accessory union;

receiving the sensed data into the processor;

processing the data, outputting instructions based on the processed data to a controller;

receiving the output instructions into the controller;

and utilizing the instructions to control any one or both of the position of the payload carriage and the force profile of the payload carriage being applied to a user of the exercise machine.

7. An exercise machine, comprising:

at least one stage, the at least one stage comprising a frame, the at least one stage comprising a Y rod having a configuration oriented in a Y coordinate direction, the Y rod being mounted on the frame for movement of the Y rod in a X coordinate direction, the Y coordinate direction and the X coordinate direction being mutually perpendicular, and the at least one stage comprising a X rod having a configuration oriented in the X coordinate direction, the X rod being mounted on the frame for movement of the X rod in the Y coordinate direction;

at least one payload carriage, the Y rod and the X rod being connected to the at least one payload carriage with the at least one payload carriage being movable on the Y rod and the X rod relative to the frame in response to movements of the Y rod and the X rod on the frame;

at least one accessory union, the at least one accessory union being securely affixed to the at least one payload carriage;

at least one sensor, the at least one sensor comprises means for detecting any one or more of the position, velocity, acceleration, and force of the at least one accessory union;

at least one human machine interface and at least one processor, the human machine interface comprises means to accept input instructions from a user and to transmit the input instructions to the processor, wherein the processor comprises means to receive the input instructions from the human machine interface, to receive data from the at least one sensor, to process received data, and to output instructions based on the processed data;

and at least one controller, the at least one controller comprising means to receive the output instructions from the at least one processor and to utilize the output instructions to control any one or both of the position of the payload carriage and the force profile of the payload carriage being applied to a user of the exercise machine;

and wherein the at least one payload carriage is movably affixed to the at least one stage by the Y rod and the X rod, the at least one stage comprising the Y rod and the X rod to constrain the motion of the at least one payload carriage along a desired path and at least one driver mechanism to control the motion of the payload carriage within the desired path;

and wherein the exercise machine further comprises an exercise accessory removably affixed to the at least one accessory union.

8. An exercise machine as in claim 7, wherein the exercise accessory is a barbell accessory.

9. An exercise machine as in claim 8, wherein the at least one stage is a planar stage such that motion of the at least one payload carriage is constrained to planar motion.

10. An exercise machine as in claim 9, wherein the number of planar stages is two and wherein the two stages are positioned such that the planar surface which defines the constrained motion of the first stage is parallel to the planar surface which defines the constrained motion of the second stage.

11. An exercise machine as in claim 10, wherein one end of the barbell accessory is removably affixed to the accessory union of the first stage and the other end of the barbell accessory is removably affixed to the accessory union of the second stage.

12. An exercise machine as in claim 8, wherein the barbell accessory is slidably affixed to the at least one accessory union, allowing for four degrees of freedom of motion of the barbell accessory, specifically the pitch, yaw, vertical and horizontal directions required for simulating a weighted, unconstrained barbell.

13. An exercise machine as in claim 8, wherein the barbell accessory further comprises at least one sensor with means of for detecting a user's engagement with the barbell accessory in at least one location along the barbell accessory length.

14. An exercise machine as in claim 10, further comprising at least one hinge mechanism allowing for each stage to be collapsed into a compact configuration.

15. An exercise machine as in claim 7, further comprising at least one accessory mechanism with means to simulate a variety of weighted cable pulls.

16. An exercise machine as in claim 7, further comprising at least one accessory mechanism with means to simulate a leg press exercise device.

17. An exercise machine as in claim 7, further comprising at least one accessory mechanism with means to simulate an abdominal exercise device.

18. An exercise machine as in claim 7, further comprising at least one accessory mechanism with means to simulate a back exercise device.

19. An exercise machine as in claim 10, further comprising at least one accessory mechanism with means to simulate a rowing machine exercise device.

20. An exercise machine as in claim 7 wherein the at least one stage is a planar stage such that motion of the at least one payload carriage is constrained to planar motion.

* * * * *